US008808113B2

(12) United States Patent
Aoyama et al.

(10) Patent No.: US 8,808,113 B2
(45) Date of Patent: Aug. 19, 2014

(54) GOLF BALL SURFACE PATTERNS COMPRISING A CHANNEL SYSTEM

(75) Inventors: Steven Aoyama, Marion, MA (US); Michael J. Sullivan, Barrington, RI (US); Edmund A. Hebert, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 478 days.

(21) Appl. No.: 13/238,355

(22) Filed: Sep. 21, 2011

(65) Prior Publication Data

US 2012/0040778 A1 Feb. 16, 2012

Related U.S. Application Data

(60) Continuation-in-part of application No. 12/356,632, filed on Jan. 21, 2009, now Pat. No. 8,033,933, and a continuation-in-part of application No. 12/233,649, filed on Sep. 19, 2008, now Pat. No. 8,137,216, which is a continuation-in-part of application No. 11/025,952, filed on Jan. 3, 2005, now Pat. No. 7,588,505, said application No. 12/356,632 is a continuation-in-part of application No. 12/061,779, filed on Apr. 3, 2008, now Pat. No. 7,867,109, which is a continuation-in-part of application No. 11/141,093, filed on May 31, 2005, now Pat. No. 7,455,601, which is a division of application No. 10/077,090, filed on Feb. 15, 2002, now Pat. No. 6,905,426.

(51) Int. Cl.

| | |
|---|---|
| ***A63B 37/12*** | (2006.01) |
| ***A63B 37/00*** | (2006.01) |

(52) U.S. Cl.

CPC ..... *A63B 37/0004* (2013.01); *A63B 37/0019* (2013.01); *A63B 37/0007* (2013.01); *A63B 37/0006* (2013.01); *A63B 37/0011* (2013.01); *A63B 37/0009* (2013.01); *A63B 37/0021* (2013.01); *A63B 37/002* (2013.01)

USPC ..... 473/383

(58) Field of Classification Search

USPC ..... 473/378–385

See application file for complete search history.

(56) References Cited

U.S. PATENT DOCUMENTS

| | | | |
|---|---|---|---|
| 1,666,699 | A | 4/1928 | Hagen |
| 2,002,726 | A | 5/1935 | Young |
| 4,090,716 | A | 5/1978 | Martin et al. |
| 4,681,323 | A | 7/1987 | Alaki |
| 4,762,326 | A | 8/1988 | Gobush |
| 4,765,626 | A | 8/1988 | Gobush |
| 4,772,026 | A | 9/1988 | Gobush |
| 4,787,638 | A | 11/1988 | Kobayashi |
| 4,830,378 | A | 5/1989 | Aoyama |
| 4,869,512 | A | 9/1989 | Nomura |
| 4,979,747 | A | 12/1990 | Jonkouski |

(Continued)

FOREIGN PATENT DOCUMENTS

| | | |
|---|---|---|
| GB | 2103939 A | 3/1983 |
| JP | 07-289662 | 7/1996 |
| JP | 2001-321460 | 11/2001 |
| WO | WO 00/48687 | 2/2000 |

*Primary Examiner* — Raeann Gorden

(57) ABSTRACT

A golf ball having an improved surface pattern is disclosed. The golf ball has one or more channels on its surface. The channels form spherical polygonal tiles that may include a plurality of dimples. These dimples may be circular or polygonal in shape.

16 Claims, 27 Drawing Sheets

(56) References Cited

U.S. PATENT DOCUMENTS

| | | | |
|---|---|---|---|
| 4,991,852 | A | 2/1991 | Pattison |
| 5,005,838 | A | 4/1991 | Oka |
| 5,158,300 | A | 10/1992 | Aoyama |
| 5,174,578 | A | 12/1992 | Oka et al. |
| 5,338,039 | A | 8/1994 | Oka et al. |
| 5,377,989 | A | 1/1995 | Machin |
| 5,470,076 | A | 11/1995 | Codorniga |
| 5,503,398 | A | 4/1996 | Lu |
| 5,536,013 | A | 7/1996 | Pocklington |
| 5,566,943 | A | 10/1996 | Boehm |
| 5,601,503 | A | 2/1997 | Yamagishi et al. |
| 5,735,757 | A | 4/1998 | Moriyama |
| 5,857,924 | A | 1/1999 | Miyagawa et al. |
| 5,957,787 | A | 9/1999 | Hwang |
| 6,059,671 | A | 5/2000 | Asakura |
| 6,162,136 | A | 12/2000 | Aoyama |
| 6,176,793 | B1 | 1/2001 | Sullivan et al. |
| 6,290,615 | B1 | 9/2001 | Ogg |
| 6,383,092 | B1 | 5/2002 | Ogg |
| 6,475,105 | B1 | 11/2002 | Murphy |
| 6,632,150 | B1 | 10/2003 | Ogg |
| 6,905,426 | B2 | 6/2005 | Morgan et al. |
| 7,309,298 | B2 | 12/2007 | Morgan et al. |
| 7,455,601 | B2 | 11/2008 | Morgan et al. |
| 2004/0005937 | A1* | 1/2004 | Saiz ..... 473/351 |
| 2006/0148591 | A1 | 7/2006 | Hebert et al. |

* cited by examiner

GOLF BALL SURFACE PATTERNS COMPRISING A CHANNEL SYSTEM

CROSS-REFERENCE TO RELATED PATENT APPLICATIONS

This application is a continuation-in-part of U.S. patent application Ser. No. 12/356,632, filed on Jan. 21, 2009 now U.S. Pat. No. 8,033,933, and a continuation-in-part of U.S. patent application Ser. No. 12/233,649, filed on Sep. 19, 2008 now U.S. Pat. No. 8,137,216, which is itself a continuation in part of Ser. No. 11/025,952, filed on Jan. 3, 2005 and issued as U.S. Pat. No. 7,588,505. U.S. patent application Ser. No. 12/356,632 is also a continuation-in-part of U.S. patent application Ser. No. 12/061,779, filed on Apr. 3, 2008 and issued as U.S. Pat. No. 7,867,109, which is a continuation-in-part of U.S. patent application Ser. No. 11/141,093, filed on May 31, 2005 and issued as U.S. Pat. No. 7,455,601, which is a divisional of U.S. patent application Ser. No. 10/077,090 filed on Feb. 15, 2002 and issued as U.S. Pat. No. 6,905,426. These applications and patents are all incorporated by reference herein in their entireties.

FIELD OF THE INVENTION

The present invention relates to golf balls, and more particularly, to golf balls having improved surface patterns. More specifically, the present invention relates to golf balls having variable width/depth ridges or channels on the golf ball surface.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities, thus different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on a traditional golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the boundary layer stays attached further along the ball's outer surface. As a result, there is a reduction in the area of the wake, an increase in the pressure behind the ball, and a substantial reduction in drag. It is the circumference of each dimple, where the dimple wall drops away from the outer surface of the ball, which allows dimples to create the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to improve ball performance, it is desirable to have a large number of dimples, hence a large amount of dimple circumference. In arranging the dimples, an attempt is made to minimize the space between dimples, because such space does not improve aerodynamic performance of the ball. In practical terms, this usually translates into 300 to 500 circular dimples with a conventional sized dimple having a diameter that typically ranges from about 0.100 inches to about 0.180 inches.

When compared to one conventional size dimple, theoretically, an increased number of small dimples will create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball fills the small dimples, and consequently decreases the dimple's aerodynamic effectiveness.

Golf ball manufacturers continue to search for more efficient methods of changing the surface of a golf ball in order to improve the aerodynamics or to impart unique aerodynamic properties to golf balls.

SUMMARY OF THE INVENTION

The present invention is directed to a golf ball with improved surface patterns. More specifically, the present invention relates to golf balls having a system of variable width and/or height/depth ridges or channels on the golf ball surface. Preferably, the depth of the deepest portions of the ridges or channels may be from about 0.005 inches to about 0.030 inches, more preferably from about 0.010 inches to about 0.020 inches. Preferably, the width of the widest points of the ridges or channels may be from about 0.050 inches to about 0.250 inches, more preferably from about 0.100 inches to about 0.200 inches.

The present invention is further directed to a golf ball comprising a substantially spherical outer surface and a channel system comprising one or more variable width and/or depth channels formed thereon. The channels of the present invention may be straight or curved, may or may not circumscribe the golf ball. The channels may also be discontinuous. The channels may or may not intersect other channels. They may cover as much of the ball surface as desired, up to virtually 100%, but preferably the surface coverage of the channels is less than about 40%, preferably less than about 30%, or less than about 20% or less than about 10%. The lower percentages are more preferable in cases where the channels are combined with other types of surface texture such as conventional dimples.

In some embodiments, these channels may allow the golf ball to have orientation-specific aerodynamic properties, i.e., to fly differently depending on its orientation when hit off of a tee. In other embodiments, the channels allow the ball to have greater flight symmetry. In some embodiments, there may be both channels and dimples or other features on the surface of the golf ball.

In yet another preferred embodiment, a golf ball can be formed with an outer surface having a channel surface pattern system. The channel surface pattern is formed of at least one channel defined on the outer surface. The channel surface pattern system covers from about 5% to about 40% of the outer surface. Preferably, the edge angle of the at least one channel ranges from about 16° to about 90° and the at least one channel surrounds or forms a plurality of spherical polygonal tiles.

In one of the preferred embodiments, the outer surface further comprises a plurality of dimples disposed within the spherical polygonal tiles and the dimples cover about 40% to about 90% of the outer surface of the ball. Preferably, the channel(s) and the dimples together cover about 60% to about 100% of the outer surface. Even more preferably, the channel(s) and the dimples together cover about 70% to about 90% of the outer surface, where the channel(s) covers from about 5% to about 20% of the outer surface. The dimples formed in the spherical polygonal tiles can be circular dimples, polygonal dimples or other desired shapes.

Preferably, the edge angle of the at least one channel is relatively large. More specifically, it is preferred that the edge angle of the channel is greater than the edge angle of the dimples. For example, the edge angle of the channel can range from about 18° to about 40°, and more preferably, the edge angle of the channel ranges from about 20° to about 30°. Whereas, the edge angles of the dimples are preferably less than 20° and even more preferably less than 18°.

In a preferred embodiment, the outer surface is comprised of between about 90 to about 400 spherical polygonal tiles surrounded by a continuous channel. The spherical polygonal tiles are preferably formed into a polyhedral layout. Each of the spherical polygonal tiles may include at least one dimple formed therein, and preferably, each of the spherical polygonal tiles includes a plurality of at least two dimples formed therein. For example, at least some of the tiles are preferably hexagons that further include either six triangular dimples, three diamond-shaped dimples or two trapezoidal dimples formed therein. Similarly, pentagon shaped tiles can include triangular or trapezoidal dimples as well. On the other hand hexagonal tiles may include a plurality of up to seven circular dimples and pentagonal shaped tiles may include up to six circular dimples.

In one embodiment, it is preferred that the channel surface pattern system comprises a plurality of channels that do not intersect each other and form a plurality of spherical polygonal tiles on the outer surface. Each of the tiles may contain one or more concentric channels therein. For example, the plurality of channels can form hexagonal tiles with multiple, non-intersecting channels therein. Similarly, the plurality of channels can form hexagonal and pentagonal tiles that are strategically arrange over the surface of the ball to provide symmetric aerodynamic properties.

BRIEF DESCRIPTION OF THE DRAWINGS

Further features and advantages of the invention can be ascertained from the following detailed description that is provided in connection with the drawings described below.

DETAILED DESCRIPTION

Figure 1:
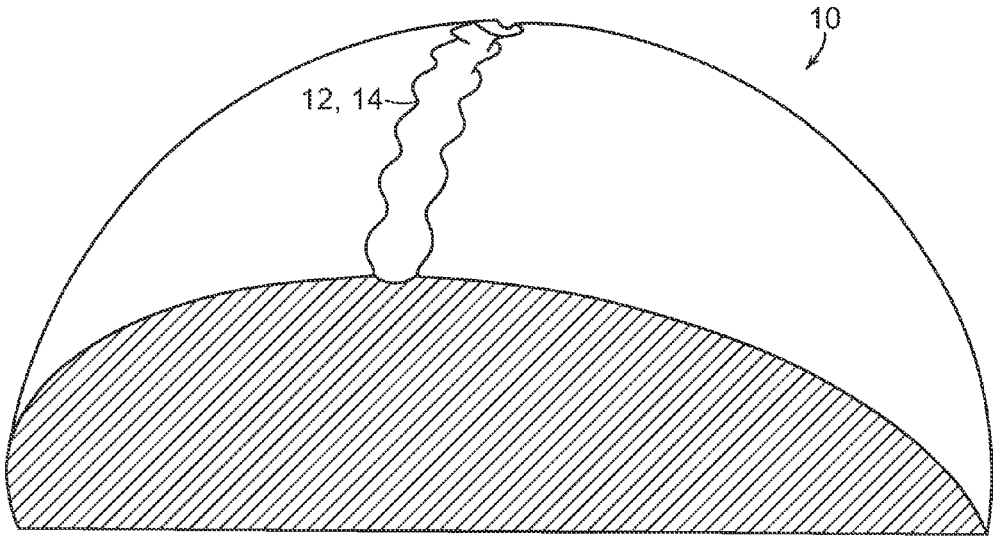
FIGS. 1-11 show exemplary channel patterns for golf balls of the present invention.

In one embodiment as illustrated in FIGS. 1-12, the present invention comprises a golf ball 10 having a system of bands, comprising one or more bands 12 to improve the ball's aerodynamics. Bands 12 are disclosed in the parent case, albeit with smooth side edges and without features to enhance the bands' appearance and aerodynamic properties, as described and claimed herein. A band 12 may be a surface channel 14, as in FIGS. 1-11, or a raised bead 16, as in FIG. 12. Channels 14 have an elevation lower than the outer surface of ball 10, and beads 16 have an elevation higher than the outer surface of ball 10. Bands 12 have a variable width and/or depth/height, either within the same band (intra-band) or between bands (inter-band), and may be continuous or discontinuous. Bands 12 may have any desired shape or pattern. This may include, but is not limited to, geometric patterns, fractal patterns, irregular patterns, linear and non-linear lines, and the like. In one embodiment, it may be desirable for the pattern to be a combination of at least two of geometric patterns, fractal patterns, irregular patterns, and lines. Golf ball 10 may have a single band 12 that transcribes the ball as illustrated in FIGS. 1-12 or may comprise multiple intersecting or non-intersecting bands 12, as illustrated in FIGS. 13-26. Bands 12 may have any shape, including, but not limited to linear, circular, oval, arcuate, sinusoid, irregular, or combinations thereof. Bands 12 may comprise concave or convex features thereon. Bands 12 may be intersecting, overlapping, non-intersecting, or any combination thereof. Bands may also intersect or overlap with other surface features, such as dimples, inverted dimples, or surface textures. Bands of the present invention may also have any of a variety of cross-sectional shapes, including, but not limited to, semicircular, parabolic, hyperbolic, polygonal, catenary, or irregular, and may have secondary sub-bands or sub-dimples. The cross-sectional shape of a band may also vary or change throughout the length of the band.

As seen in FIGS. 13-26, golf ball 10 may comprise multiple bands 12. Bands 12 may comprise channels 14, beads 16, or a combination thereof. FIGS. 15-26 are disclosed in related application Ser. No. 11/025,952 and published as U.S. 2006/0148591, which is incorporated by reference herein in its entirety. Where ball 10 comprises multiple bands, ball 10 may also comprise one or more hubs 18. Bands 12 may intersect at hubs 18. Additional bands 12 may also begin or end at hubs 18. Hubs 18 may have any shape, and may have an elevation lower than the surface of ball 10 or an elevation higher than the surface of ball 10. Where all bands 12 are channels, hubs 18 preferably have an elevation lower than the surface of ball 10. Conversely, where all bands 12 are beads, hubs 18 preferably have an elevation higher than the surface of ball 10.

Preferably, bands 12 have a depth or height which varies along their length by between about 0.002 inches and about 0.025 inches. More preferably bands 12 have a depth or height which varies along their length by between about 0.005 inches and about 0.015 inches. Preferably, bands 12 have a depth or height at their deepest or highest points of at least about 0.005 inches and less than about 0.030 inches. More preferably, bands 12 have a depth or height at their deepest or highest points of at least about 0.010 inches and less than about 0.020 inches. Preferably, bands 12 have a width which varies along their length by between about 0.005 inches and about 0.245 inches. More preferably, bands 12 have a width which varies along their length by between about 0.010 inches and 0.195 inches. Preferably, bands 12 have a width at their widest points of at least about 0.050 inches and less than about 0.250 inches. More preferably, bands 12 have a width at their widest points of at least about 0.100 inches and less than about 0.200 inches.

Figure 27:
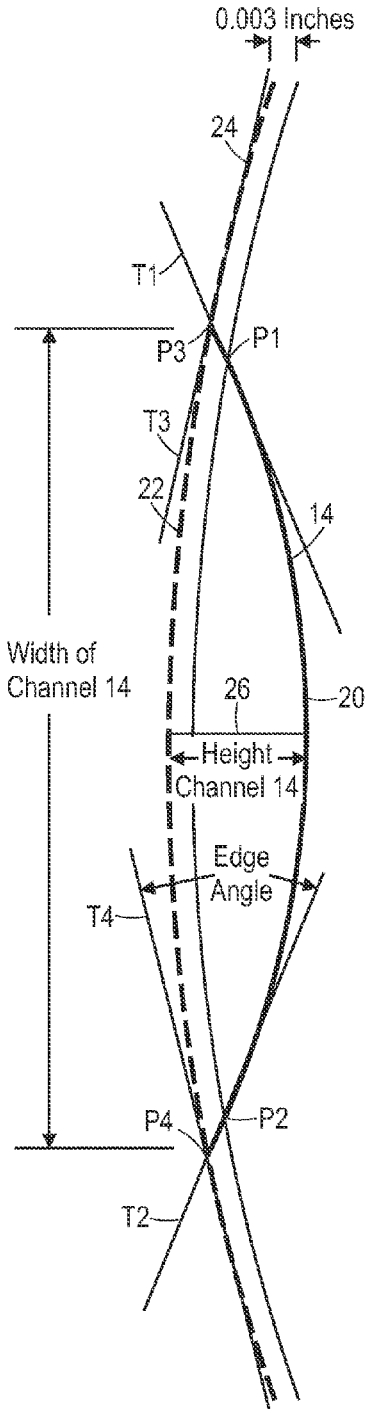
FIG. 27 is a diagram showing a preferred way to measure the depth of a channel of the present invention.
Figure 28:
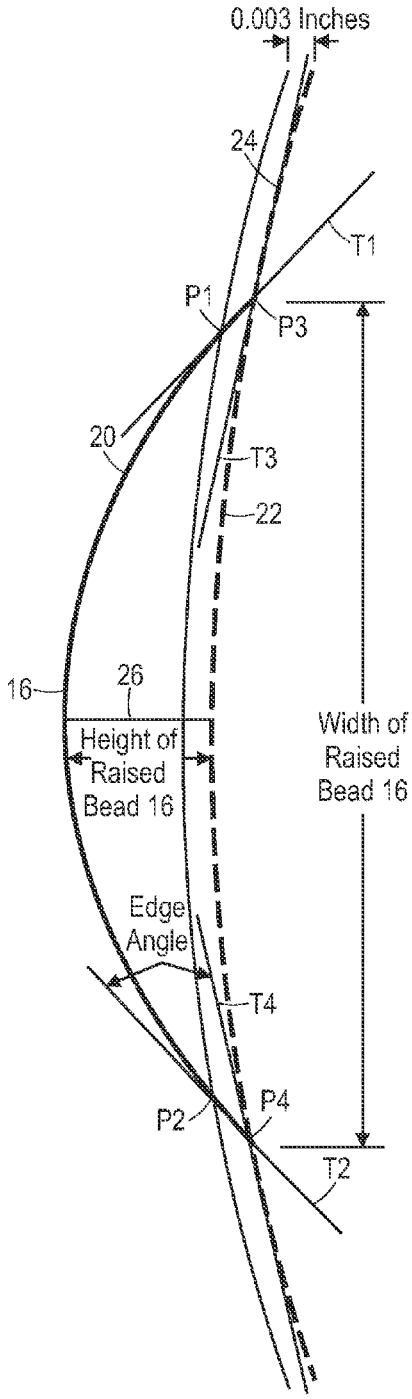
FIG. 28 is a diagram showing a preferred way to measure the height of a raised bead of the present invention.

Generally, it can be difficult to define and measure the width, depth or height, and edge angle of an irregular band due to the relative change in the depth or height due to the shape of the band as compared to the uninterrupted curvature of the ball. FIG. 27 shows a cross-sectional profile 20 taken perpendicularly across channel 14 extending between the land surfaces to either side of the channel 14. Due to the effects of ball curvature, the irregular shape of some channels, the depth of a channel is somewhat ambiguous. To resolve this problem, phantom ball surface 22 is constructed above channel 14 as a continuation of land surface 24. Then, at each local minimum on the channel profile, a line 26 is constructed perpendicular to phantom ball surface 22, wherein line 26 will pass through the center of ball 10. Depth or height of each local minimum along the cross-sectional profile can be determined by measuring the length of line 26 between the channel 14 and the phantom ball surface 22. The depth of channel 14 is the greatest of the depths of the local minima. Similarly, due to the effects of paint and/or the depression design itself, the junction between land surface 24 and channel 14 is not a sharp corner and is therefore indistinct, rendering the width and edge angle of channel 14 somewhat ambiguous. To resolve this problem, a first tangent line T1 is constructed at a point P1 on a sidewall of channel 14 that is spaced about 0.003 inches radially inward from phantom ball surface 22. T1 intersects phantom ball surface 22 at a point P3, which defines a first nominal edge position. Similarly, a second tangent line T2 is constructed in a similar manner on the sidewall opposite the sidewall used to generate T1. T2 intersects phantom ball surface 22 at point P4, which defines a second nominal edge position. The width of channel 12 is the distance between points P3 and P4. To determine the edge angles, third and fourth tangent lines T3 and T4 are constructed at points P3 and P4, respectively, on the phantom ball surface 22. The edge angle at one side of the channel is the angle between T1 and T3, and the edge angle at the other side is the angle between T2 and T4. FIG. 28 shows a cross-sectional profile 20 taken perpendicularly across a raised bead 16, in a manner similar to FIG. 27. While the procedure for determining the width, height, and edge angles of raised bead 16 are similar to the procedure for determining the width, depth, and edge angles of channel 14, there are several differences. First, local maxima on cross-sectional profile 20 are used to determine line(s) 26, and the height of bead 16 is the greatest of the heights of the local maxima. Second, tangent lines T1 and T2 are constructed tangent to the sidewalls at points 0.003 inches radially outward from phantom ball surface 22. Points P3 and P4 are constructed as described above, and the width of bead 16 is the distance between points P3 and P4.

Figure 13:
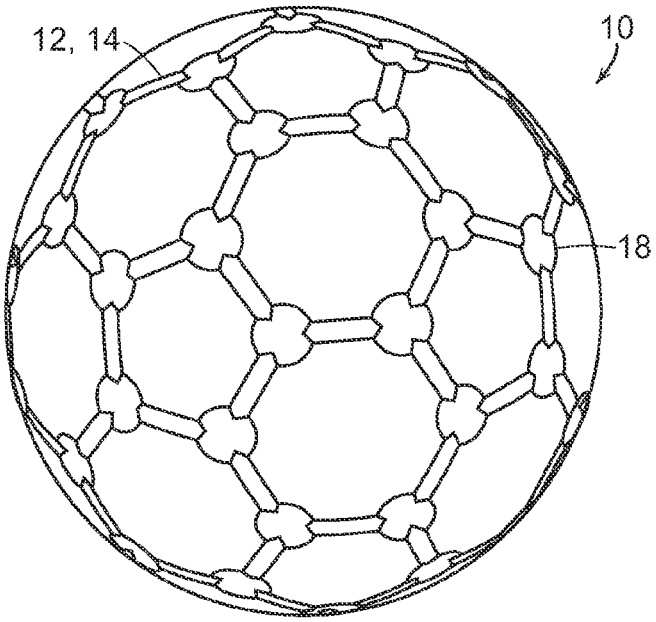
FIGS. 13-26 show exemplary channel patterns comprising hubs for golf balls of the present invention.
Figure 14:
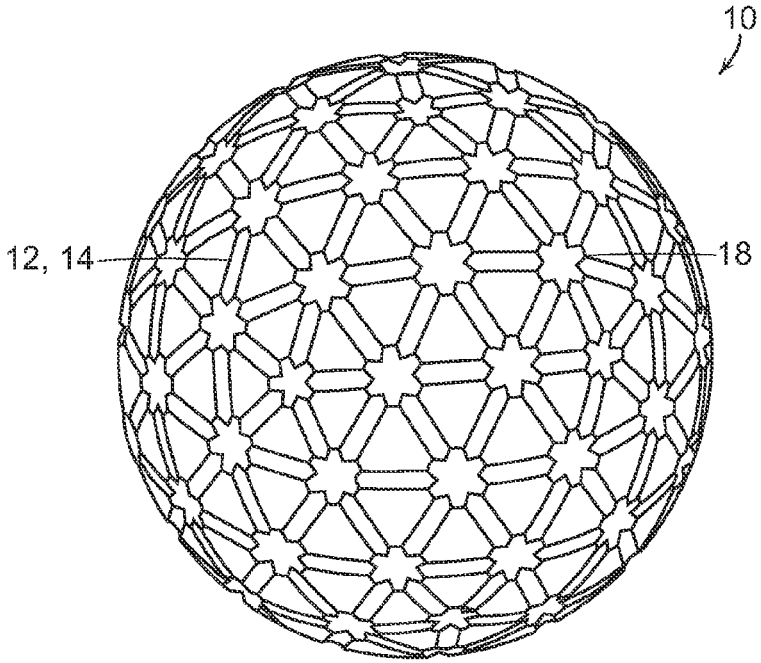
Figure 15:
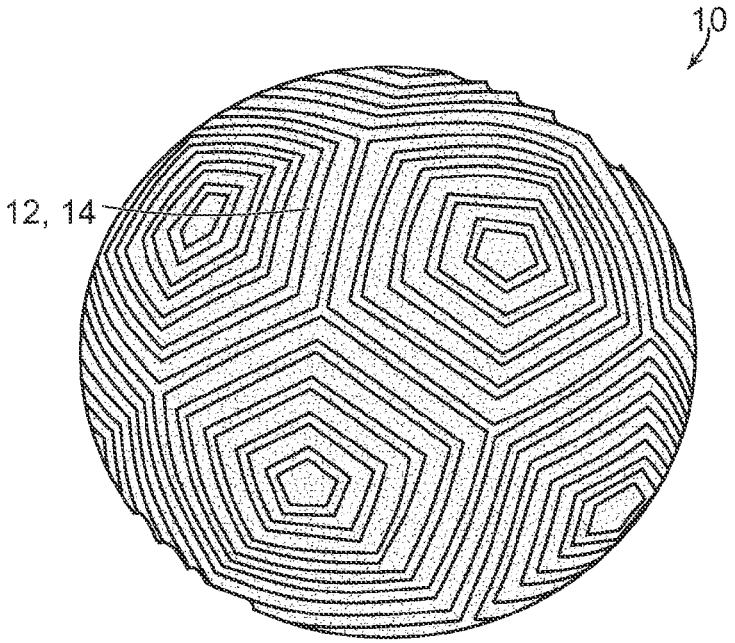
Figure 16:
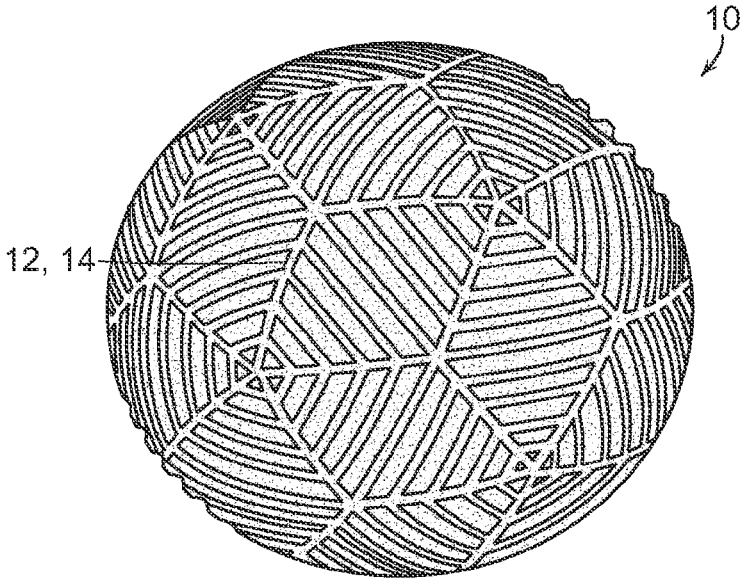
Figure 17:
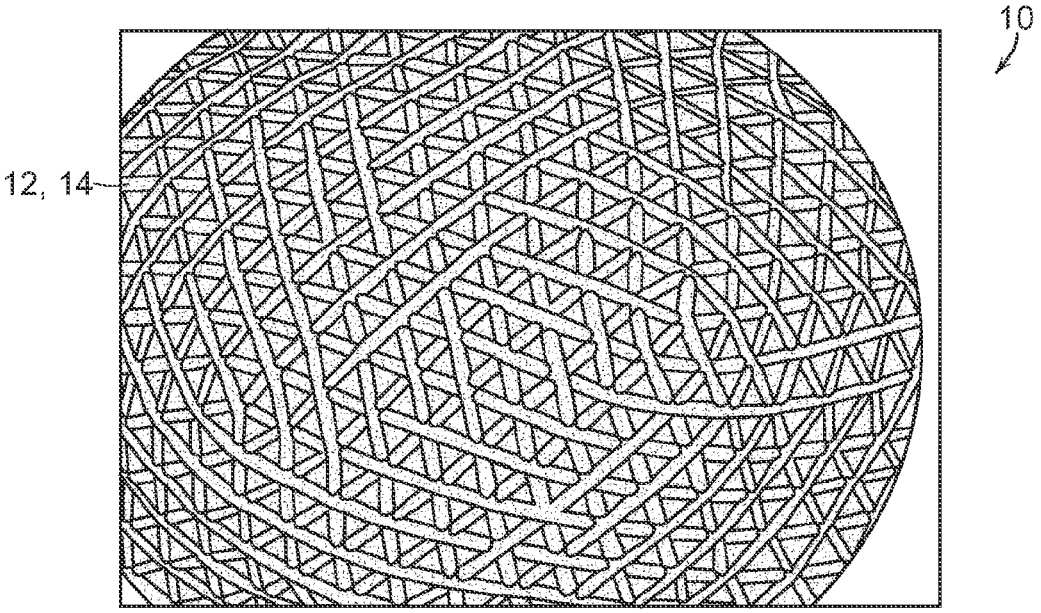
Figure 18:
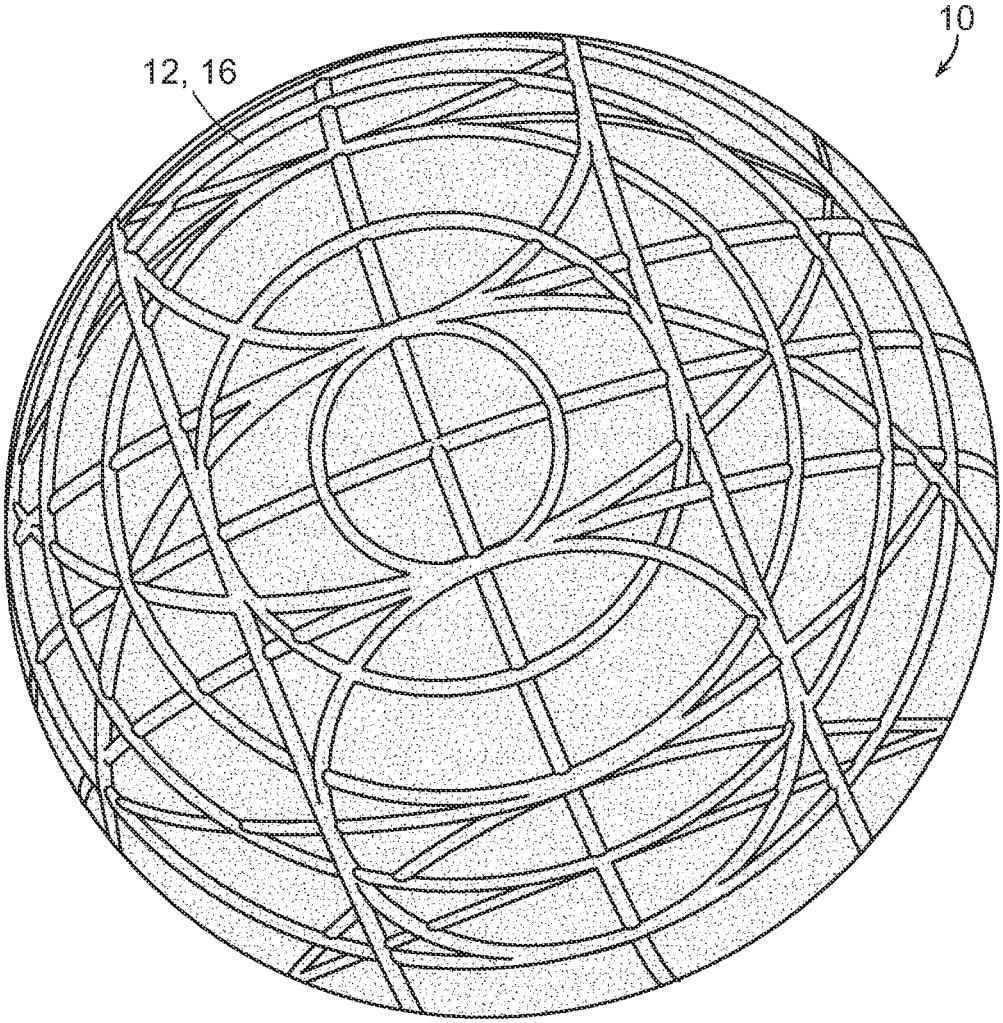
Figure 19:
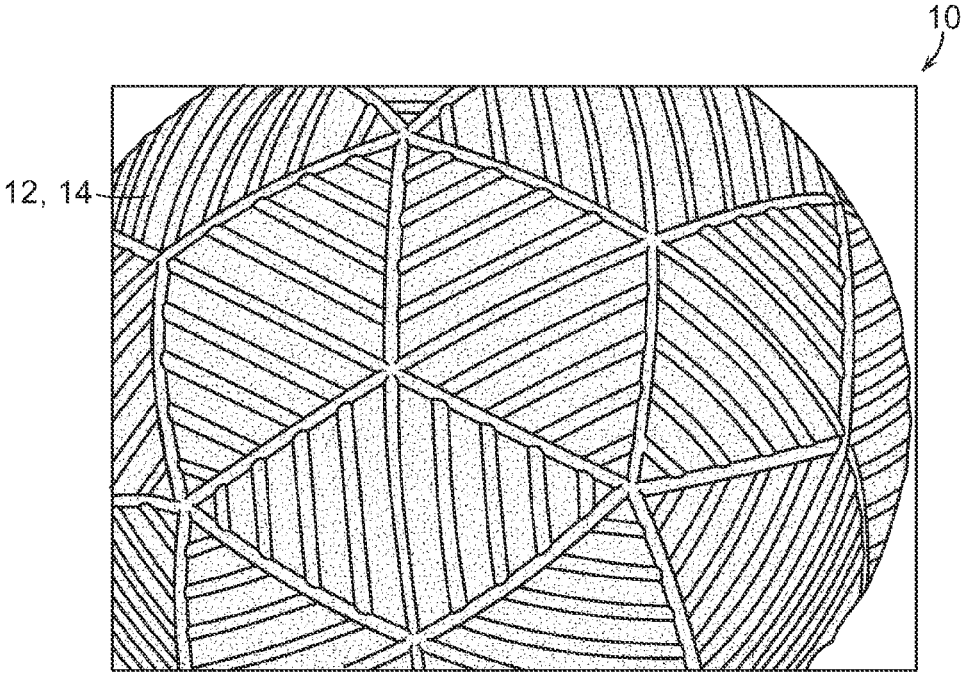
Figure 20:
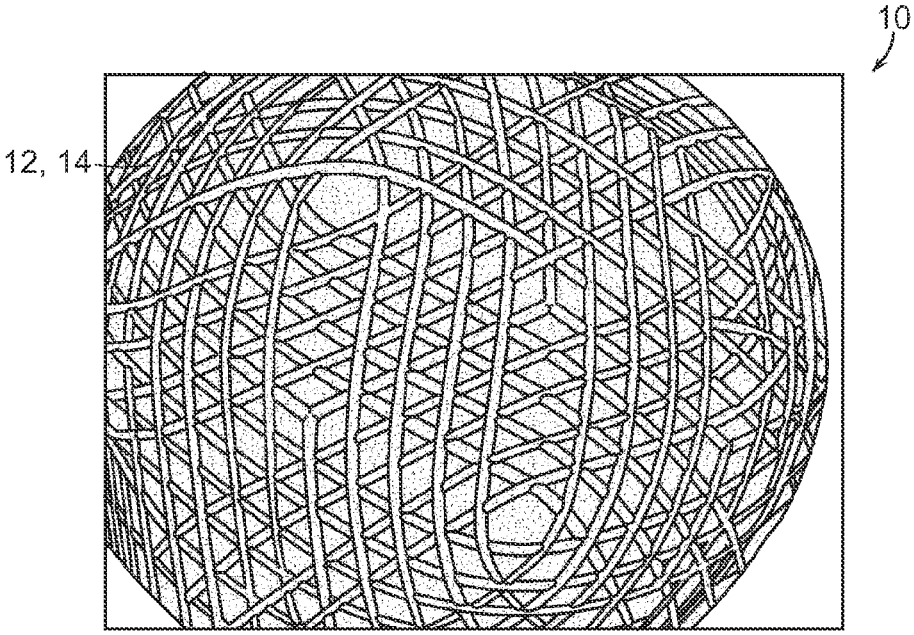
Figure 21:
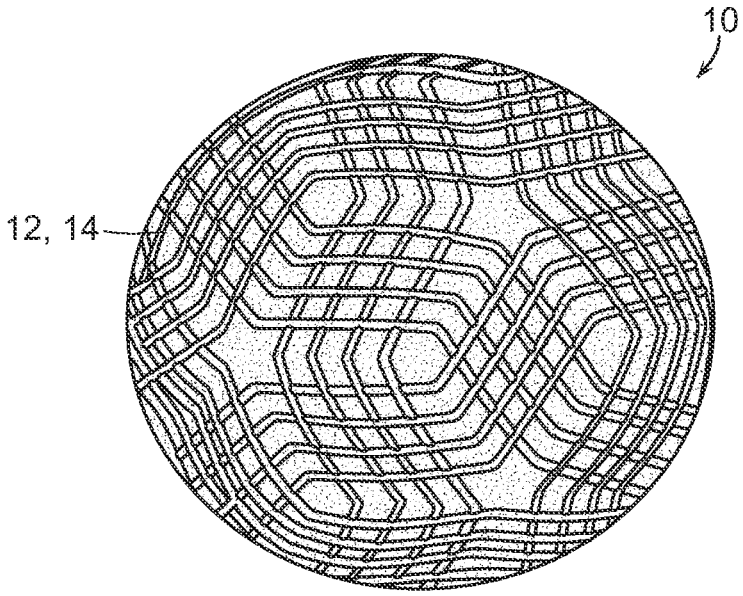
Figure 22:
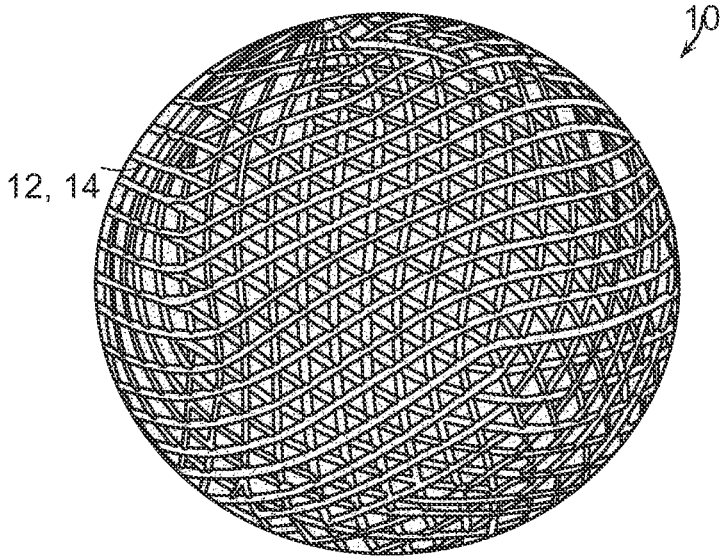
Figure 23:
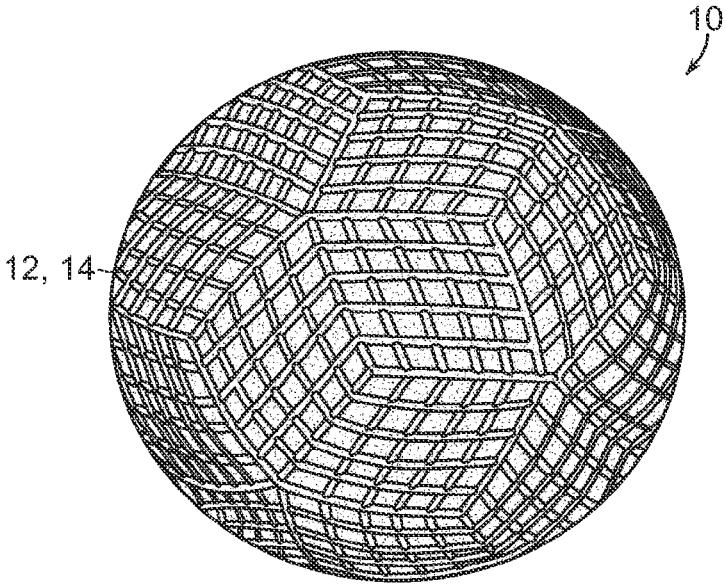

Referring to FIG. 1, ball 10 has a band system comprising at least a single channel 14 that circumscribes ball 10. In this embodiment, channel 14 has a width that varies sinusoidally between about 0.067 inches and about 0.120 inches. Channel 14 comprises about 6 percent of the surface of ball 10. As shown in FIGS. 13-14, ball 10 has a band system comprising a plurality of channels 14 and hubs 18. In the embodiment of FIG. 14, the band system comprises about 54 percent of the ball surface. Thus, bands 12 may comprise a large percentage of the ball surface, but in accordance with one aspect of the present invention, they preferably comprise about 40 percent or less of the ball surface, more preferably, about 30 percent or less, about 20 percent or less, or about 10 percent or less. The combination of relatively low coverage and variable width and height/depth provides a unique aerodynamic package for golf ball 10 that cannot be achieved with conventional circular dimples alone.

Figure 2:
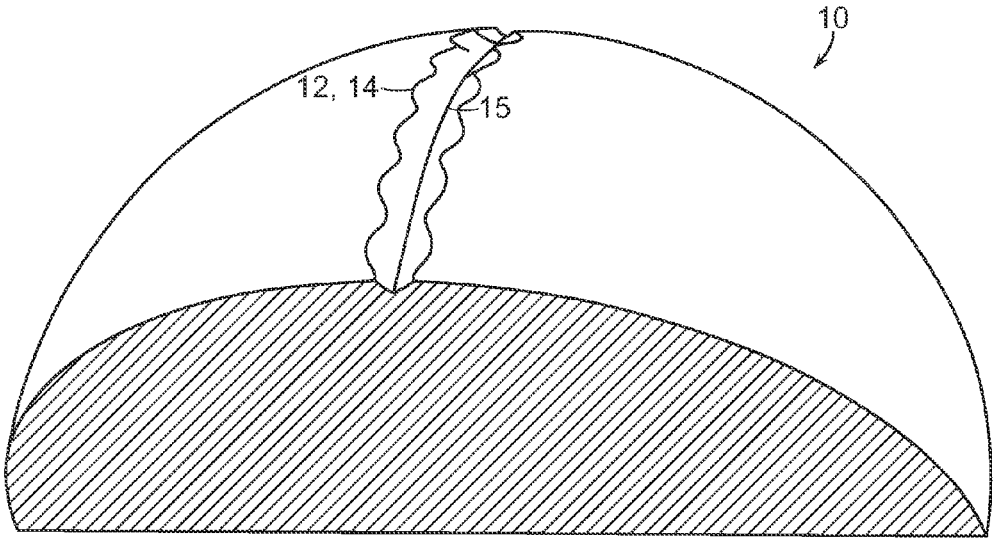
Figure 3:
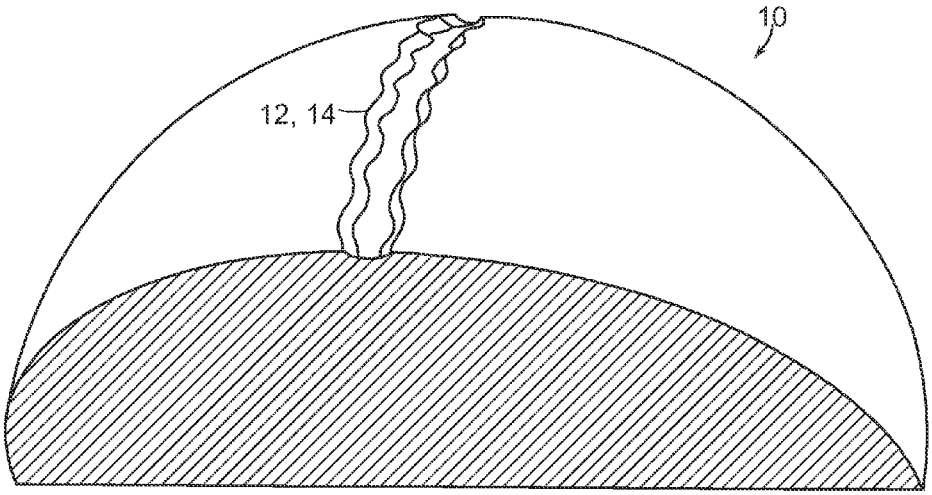
Figure 4:
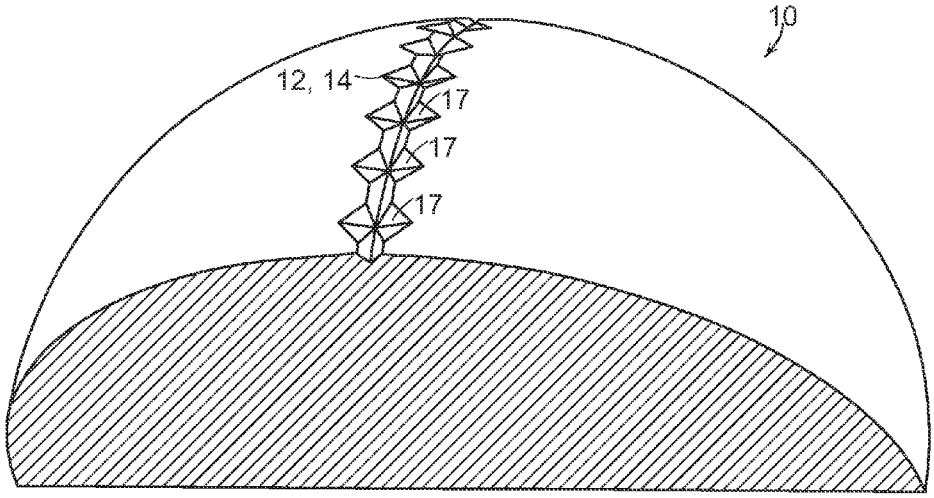
Figure 5:
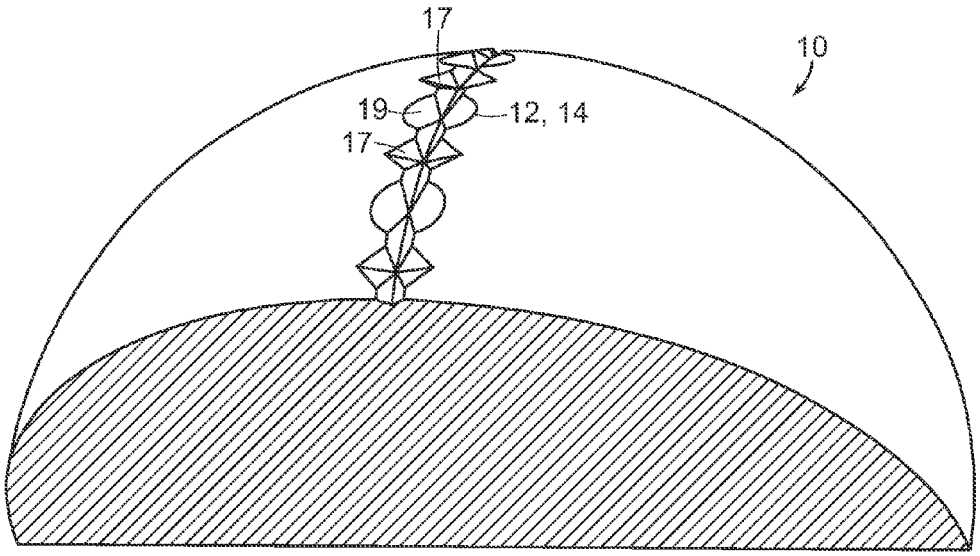
Figure 6:
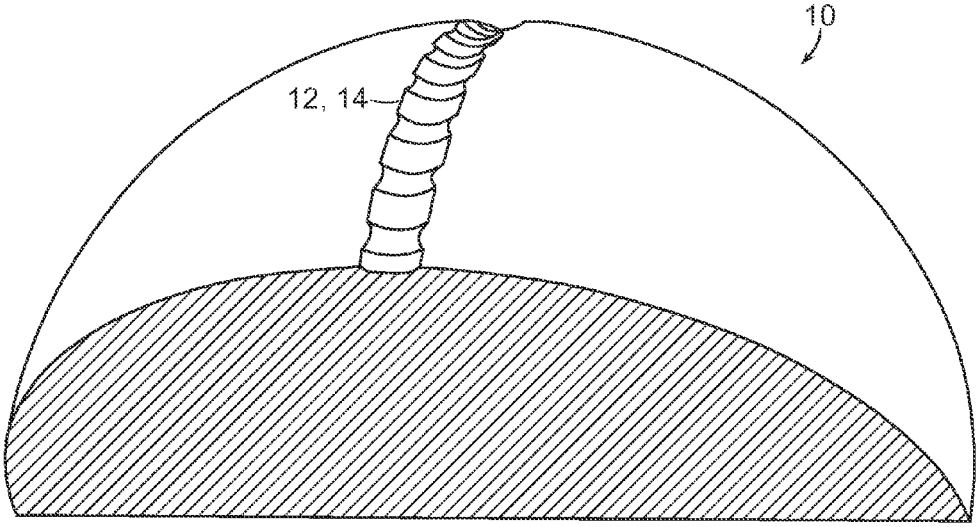
Figure 7:
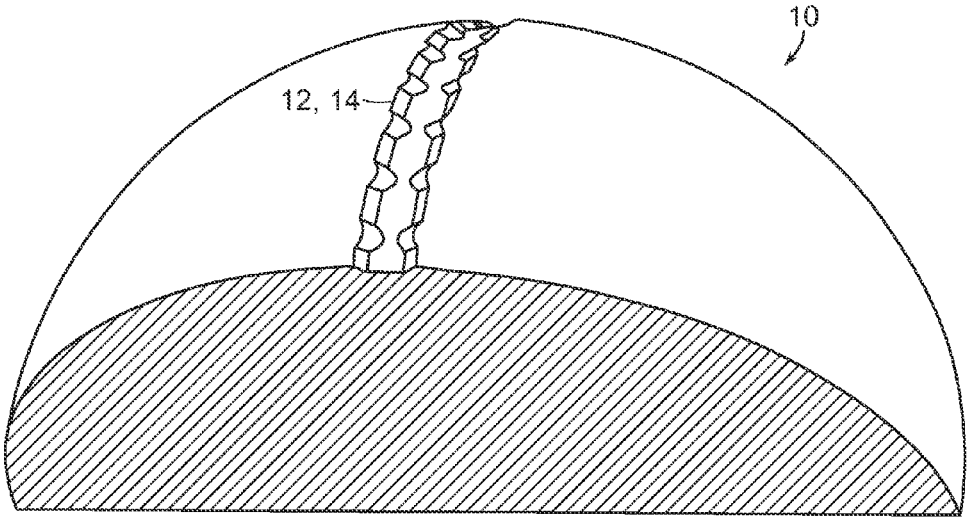
Figure 8:
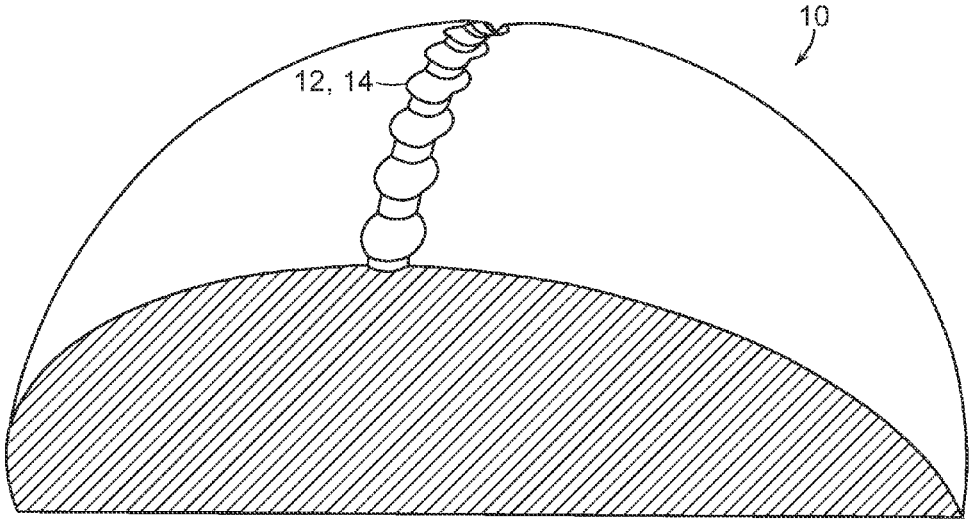
Figure 9:
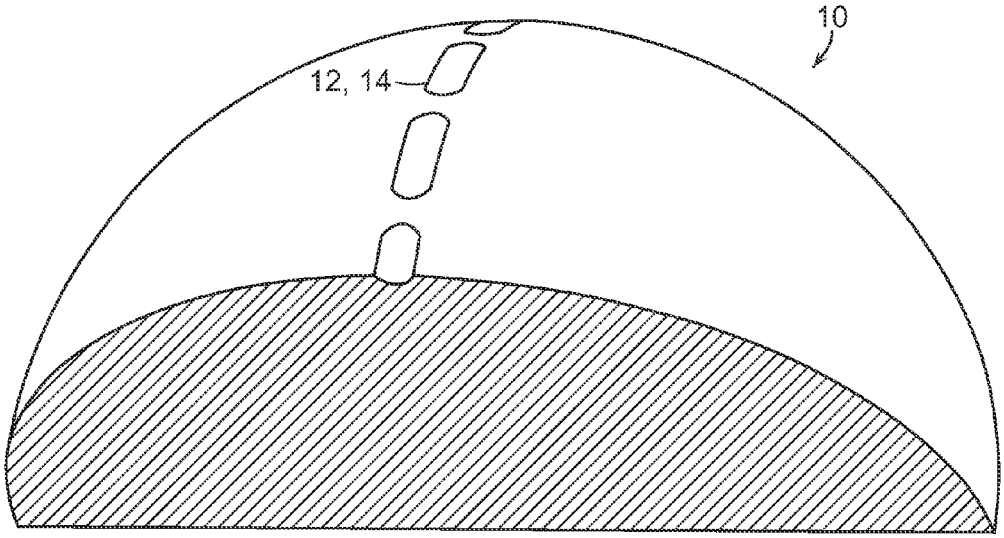

FIG. 2 illustrates a channel 14 similar to that of FIG. 1, except that a wavy channel 14 has a substantially V-shaped bottom with line 15 representing the lowest portion of the channel FIG. 3 also illustrates a channel 14 that is similar to that of FIG. 1, except that the bottom of the channel is substantially flat. The junctions between the substantially flat bottom and the sidewalls of the channel produce wavy lines that are substantially in phase with their corresponding channel edges. Alternatively, the wavy lines are substantially out of phase. FIG. 4 illustrates a channel 14 that comprises a plurality of starburst shapes 17 connected in series to each other. FIG. 5 illustrates an alternative comprising starbursts 17 separated by round or oval shapes 19. Channel 14 can be segmented as shown in FIG. 6 and in FIG. 8, wherein the segments can be round or oval. FIG. 7 shows that channel 14 can have segmented sidewalls and a substantially flat bottom. Channel 14 may comprise a broken line, as shown in FIG. 9.

Figure 10:
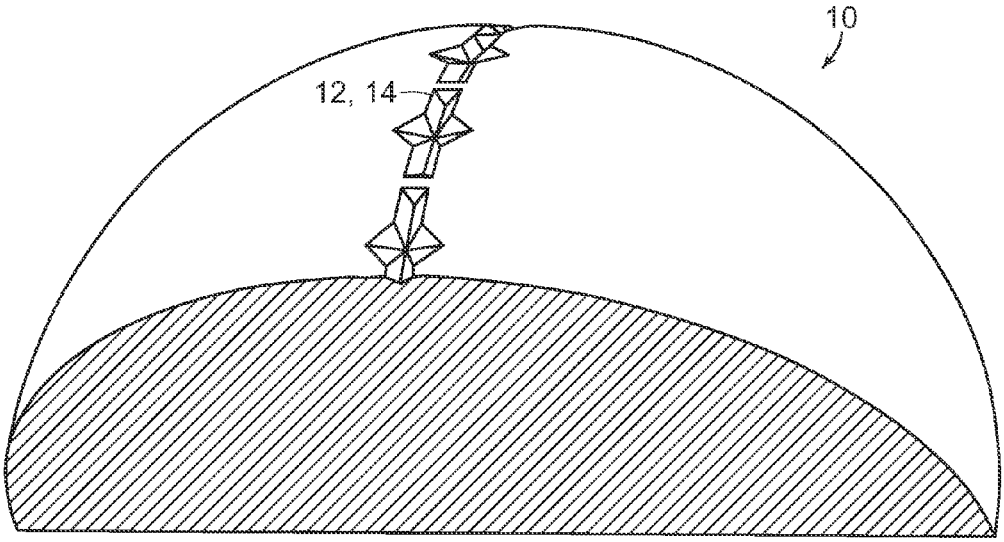
Figure 11:
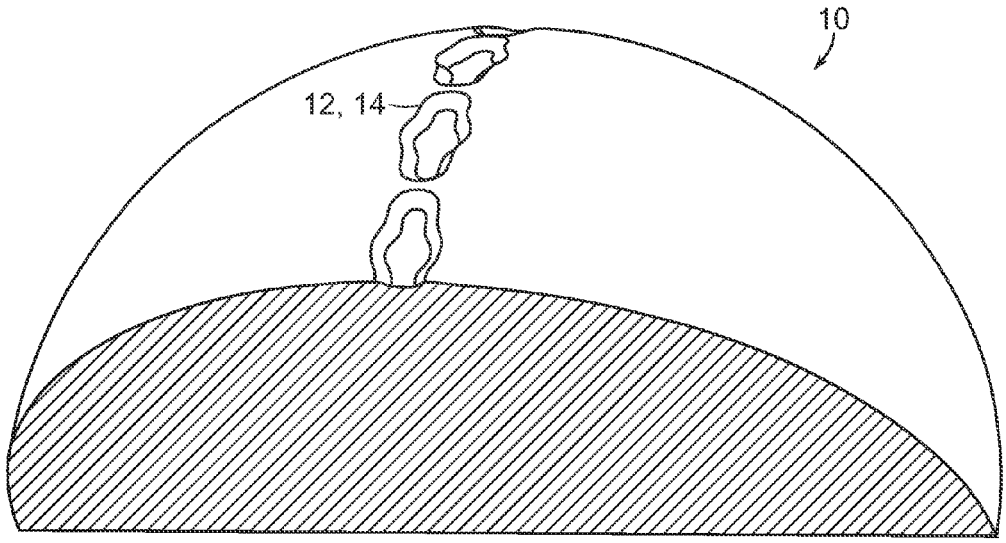
Figure 12:
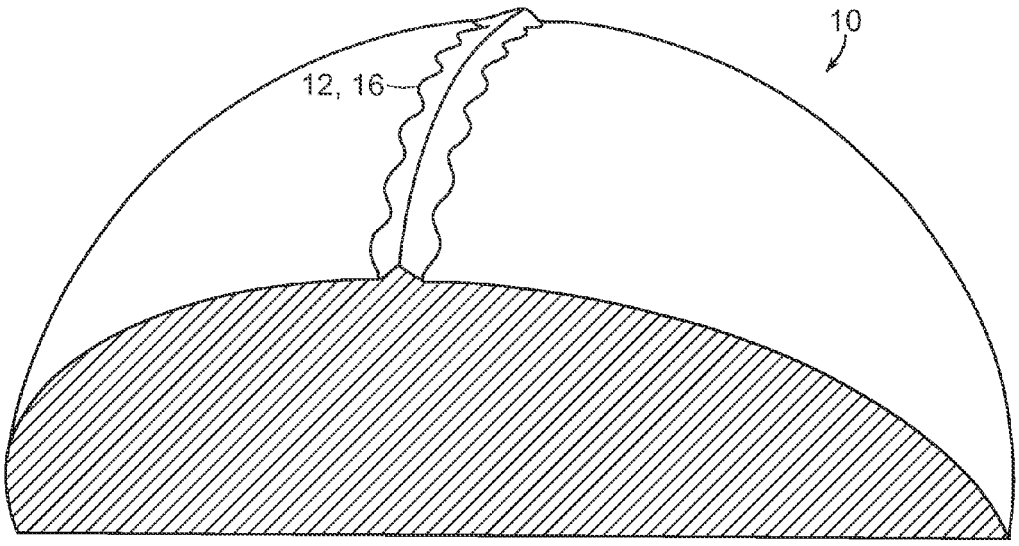
FIG. 12 shows an exemplary raised bead pattern for golf balls of the present invention.

Starbursts 17 can also be separated or spaced apart, as shown in FIG. 10, as can more rounded shapes as shown in FIG. 11.

As shown in FIGS. 1-12, the edges of channel 14 or bead 16 are not straight or smooth similar to those disclosed in the parent application, but these edges are wavy, jagged, broken. As a result, the width of channels 14 and beads 16 are preferably varying or non-constant.

Channels 14 may comprise a large percentage of the ball surface, but in accordance with one aspect of the present invention, they preferably comprise about 40% or less of the ball surface, more preferably about 30% or less, about 20% or less or about 10% or less. The lower percentages are more preferable in cases where the channels are combined with other types of surface texture such as conventional dimples. The combination of a relatively low coverage of the ball surface, i.e., about 40% or less, and relatively steep edge angle, i.e., about 16° or more, provides a unique aerodynamic package for golf ball 10 of the present invention that cannot be achieved with conventional circular dimples alone.

Preferably, channels 14 have an edge angle that is steeper than edge angles for conventional circular dimples. In one example, channels 12 have substantially the same depth as conventional circular dimples, but have a width that is significantly less than the diameter of conventional circular dimples, causing the edge angle to be steeper than the edge angle of conventional circular dimples, which typically ranges from 12°-16°. The edge angle of channels 12 is preferably greater than about 16°, more preferably greater than about 18°, and more preferably greater than about 20°. The edge angle can range from about 16° to about 90°, preferably from about 18° to about 40°, and more preferably from about 20° to about 30°. Referring to FIG. 27, the edge angles are the angles between lines T1 and T3 on one side of the channel, and T2 and T4 on the other side. The edge angles on the two sides usually, but not always, agree.

One advantage of having relatively low surface coverage is that golf ball 10 behaves more like a true sphere and less like a faceted object when putting. This results in a truer direction of departure from the putter face, and a truer roll along the ground. This would be advantageous to all golfers, but especially to highly skilled golfers who will enjoy the full benefit of their putting skills because of the reduced influence of randomness.

Figure 24:
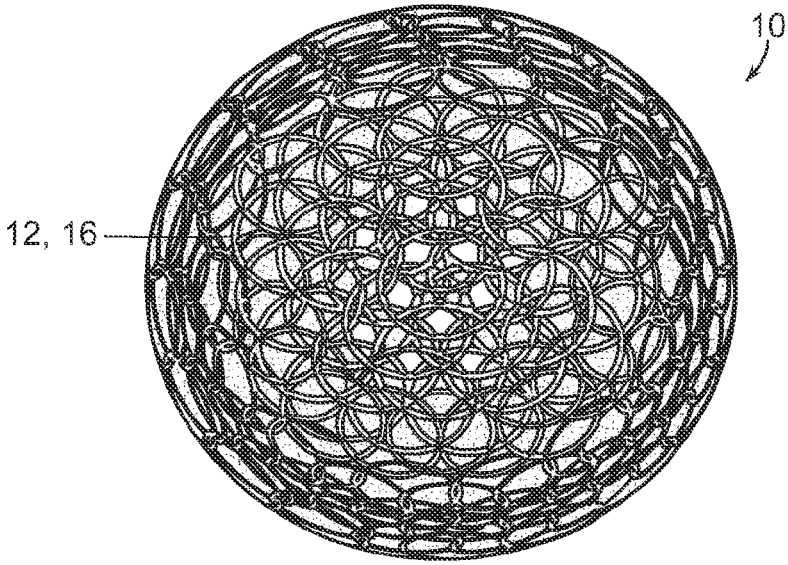
Figure 25:
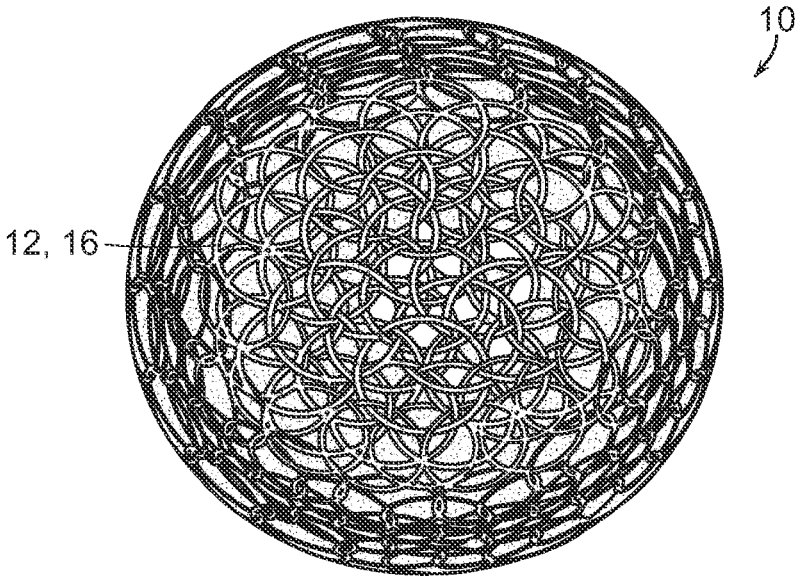
Figure 26:
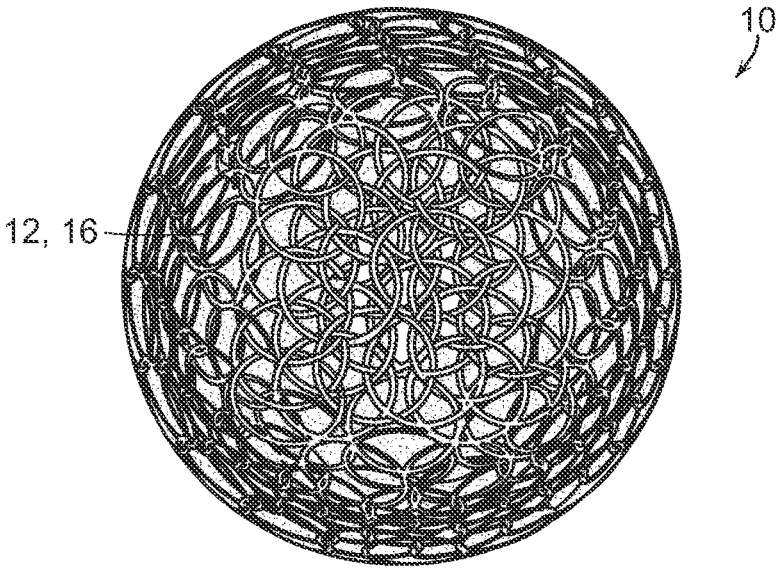
Figure 29:
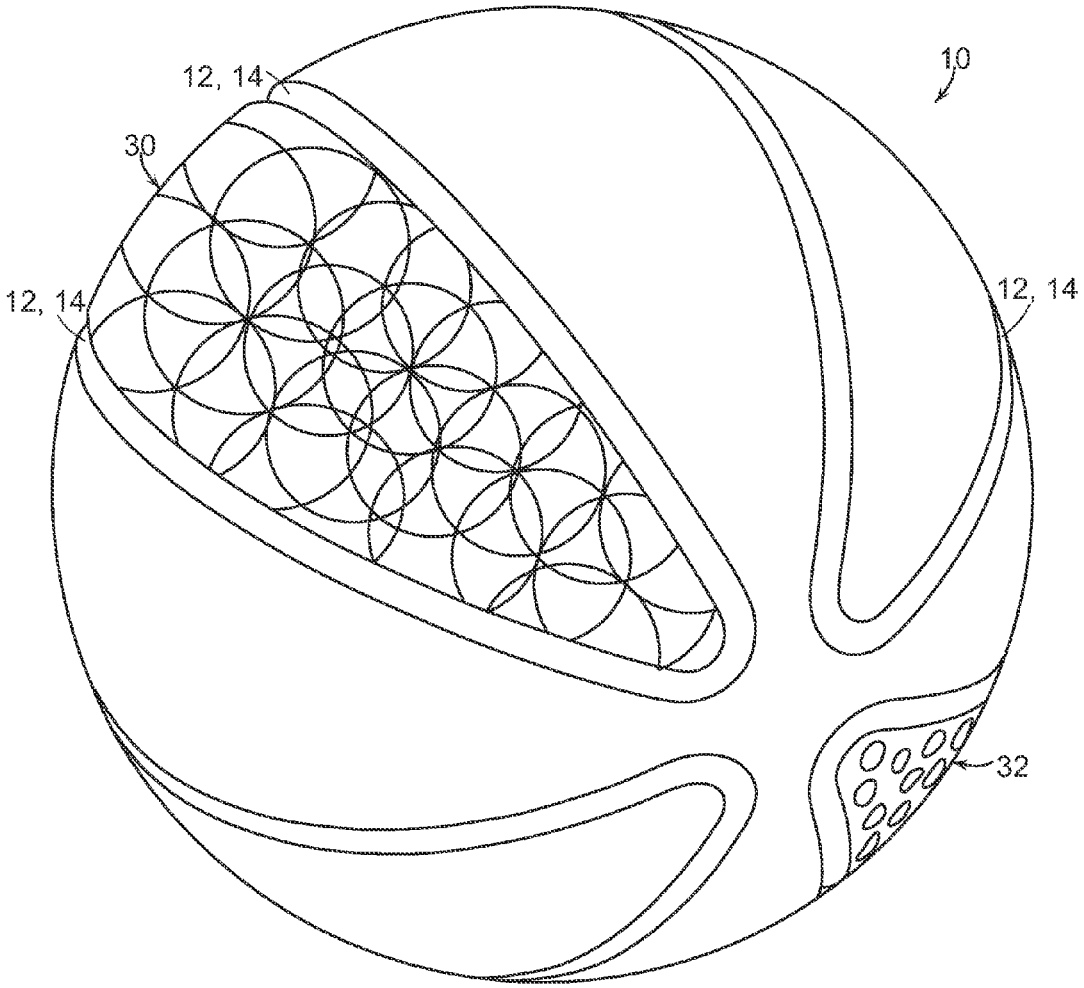
FIG. 29 shows an exemplary channel pattern wherein the spaces between the primary channel system are filled with a secondary channel system, texture, or dimples.

However, it may be desirable to include dimples, bumps, pimples (inverted dimples), or other surface textures on the golf ball surface in addition to the channels. The dimples may be circular, or may have non-circular perimeters such as oval, hour-glass shape, regular and irregular polygons. Accordingly, the dimples may be triangular, rectangular, pentagonal, hexagonal, or any other suitable polygonal shape or non-polygonal shapes, or may have polygonal and non-polygonal portions. Another advantage of the present invention is that bands 12 having a variable width provide more efficient demarcation lines or groupings of both traditional and non-traditional dimples. Exemplary non-traditional dimples include the surface textures and band systems shown in FIGS. 15-26. In one example, the surface pattern shown in FIGS. 24 and 25 are added to a portion of ball 10, illustrated in FIG. 29 at grouping 30. All surface patterns disclosed in this parent application can be used in the present invention. This pattern may be added to all the areas not covered by channels 12, or combinations of distinct patterns can be used. Traditional circular dimples can also be used, as shown in grouping 32. Non-traditional dimples such as figure-eight or barbell dimples can be used as well.

Figure 30:
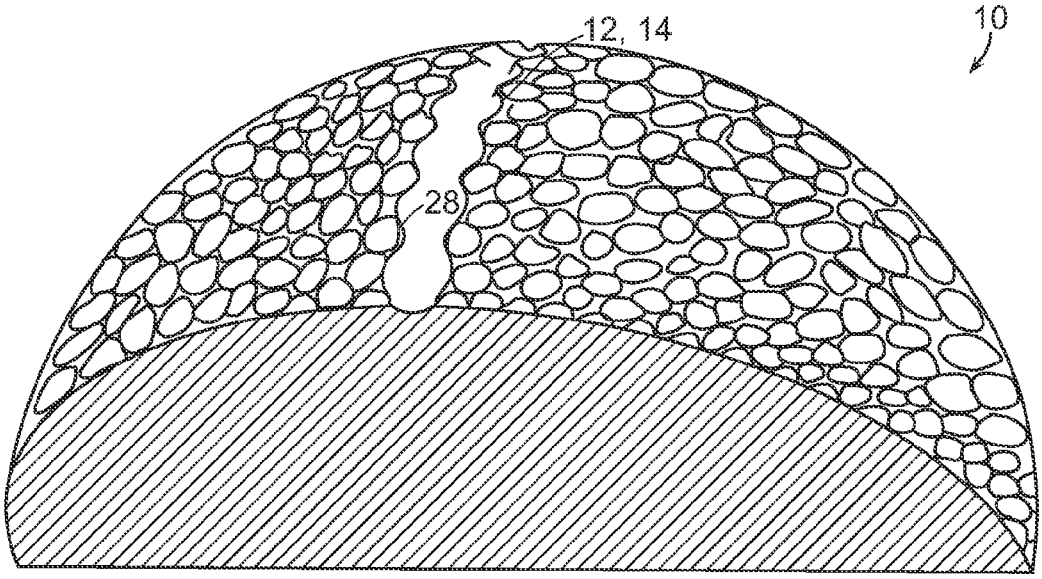
FIG. 30 shows an exemplary channel pattern and dimples.

The channels are combined with dimples to increase the percentage of golf ball surface covered in dimples and channels to a level comparable to or greater than traditional golf balls. In one example, the surface coverage of bands 12 is in between about 5% to about 40% and the dimple coverage can be from about 40% to about 90%, with a total dimple/band coverage ranging from about 60% to 100%. More preferably, the total dimple/band coverage ranges from about 70% to 90%, and most preferably from about 75% to 85%. The synergistic combination of traditional dimples and a variable width band can be seen in FIG. 30. In this embodiment, variable width of channel 14 allows channel 14 and dimples 28 to achieve tighter packing on surface of golf ball 10. The waviness of the width of channel 14 can accept circular dimples at the troughs of the waves, to increase dimple packing. Channel 14 may also overlap the parting line from the molding process, thereby masking the parting line. Thus, overall surface coverage increases over either the use of non-variable width channels along with dimples or dimples alone.

In another embodiment, as seen in FIGS. 9-11, channel 14 is dis- or non-continuous, wherein the channel takes the form of hash marks or dotted-line appearance with land area interspersed within an otherwise continuous band. This allows another unique aerodynamic package, by providing additional methods of perturbing the boundary layer flow.

In another embodiment of the invention, a network of grooves or channels is formed on the surface of the ball, delineating a large number of spherical polygonal areas or tiles. Any technique may be used to arrange the grooves, but it is preferable to use a polyhedron such as an octagon, icosahedron, cuboctahedron, or a dodecahedron as the basis for the general layout. In a conventional dimple pattern, dimples would be arranged within the polygonal faces of the polyhedron and along their edges. In the present invention, a polyhedral layout is superimposed on the spherical surface and channels are formed at the edges of the spherical polygonal tiles.

Figure 31:
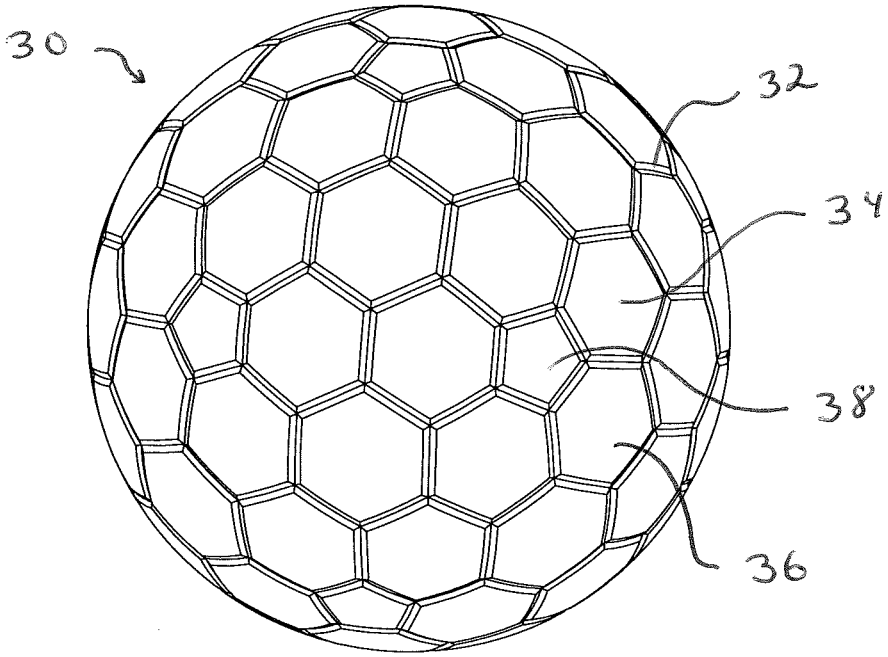
FIG. 31 shows an exemplary channel pattern arranged in an icosahedral pattern with a plurality of spherical polygonal tiles formed therebetween.

Another example of an aerodynamic configuration composed of polygonal tiles separated by channels is shown in FIG. 31. The golf ball 30 includes a plurality of channels 32 and tiles 34 that are arranged in accordance with an icosahedral based pattern having 92 tiles covering the surface of the ball. The channels 32 are interconnected and delineate 80 hexagonal tiles 36 and 12 pentagonal tiles 38 on the surface of the ball.

The cross-sectional shape of the channels or grooves 32 is not particularly limited; however, generally V-, U-, and arc shaped cross-sections as set forth in more detail above are preferred. The specific dimensions of the cross-section, such as the width, the depth, and the wall angles are selected to create the desired performance characteristics. However, as mentioned above, it is preferred that the edge angle of the channels is about 16° to about 90°. In the embodiment set forth in FIG. 31, the tiles 34 are essentially land areas or flat areas. When the tiles 34 are land areas, it is preferable to have the channels 32 cover between about 60 to 90 percent of the ball surface.

Figure 32:
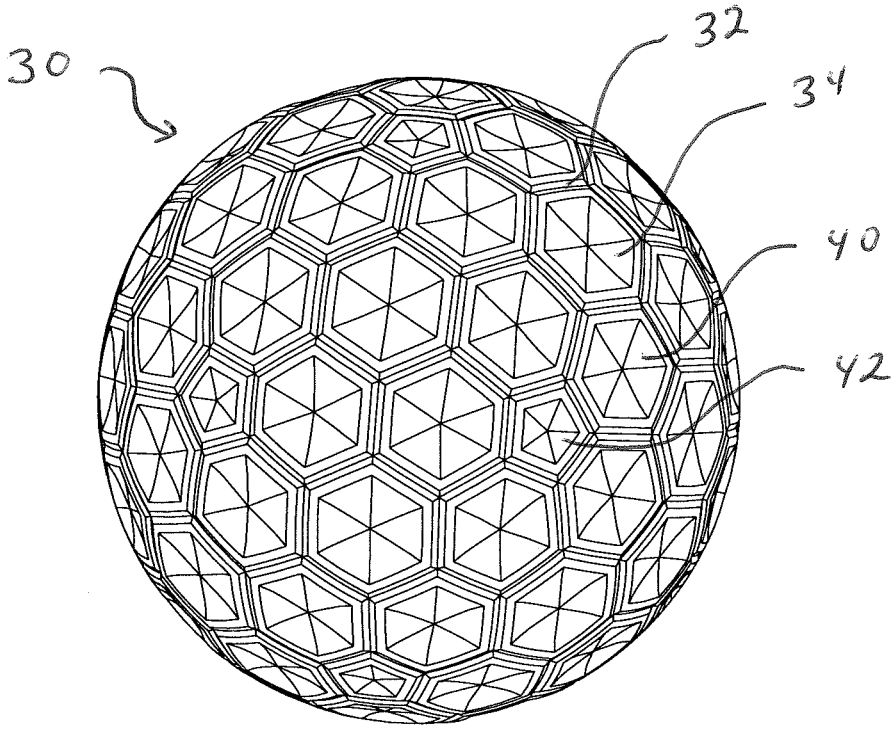
FIG. 32 shows an exemplary channel pattern arranged in an icosahedral pattern with a plurality of spherical polygonal tiles formed therebetween, wherein each tile is formed into a polygonal dimple.

In another embodiment as set forth in FIG. 32 for example, one or more polygonal dimples 40, 42 are fitted inside each of the polygonal tiles 34 defined by the channels 32. The edges of the polygonal dimple may essentially coincide with the edges of the surrounding channels, leaving little or no land area in between the channels 32 and the dimples 40, 42. In this type of embodiment, it is preferred that the channels cover about 5% to about 40% of the surface of the ball 30 and the dimples cover between about 40% to about 90% of the surface of the ball 30. Preferably, the channels 32 and the dimples 40, 42 occupy a combined about 60% to about 100% of the surface of the ball 30.

FIG. 32 further demonstrates the use of different shaped dimples in the present invention. Preferably, the dimples can include hexagonal dimples 40 and pentagonal dimples 42 with an annular land area around each dimple. The edge angles of the dimples are preferably between about 10° and about 16°. In this type of embodiment, the edge angle of the channels 32 is greater than the edge angles of the dimples 40, 42 and, more preferably, greater than the edge angles of the dimples 40, 42 by at least 5°. In another embodiment, the edge angle of the channels 32 is at least twice as great as the edge angle of the dimples 40, 42.

Still further, the cross-sectional shape of the dimples is not particularly limited. In FIG. 32, the dimples 40, 42 are multi-faceted cones. However, the dimples 40 can also be formed into a truncated cone with side surfaces and flat bottom surfaces. Similarly, the dimples could be a saucer, dimple-in-a-dimple, faceted and conical. Further examples of dimple cross-sectional shapes are parabolic, elliptical, and catenary.

Figure 33:
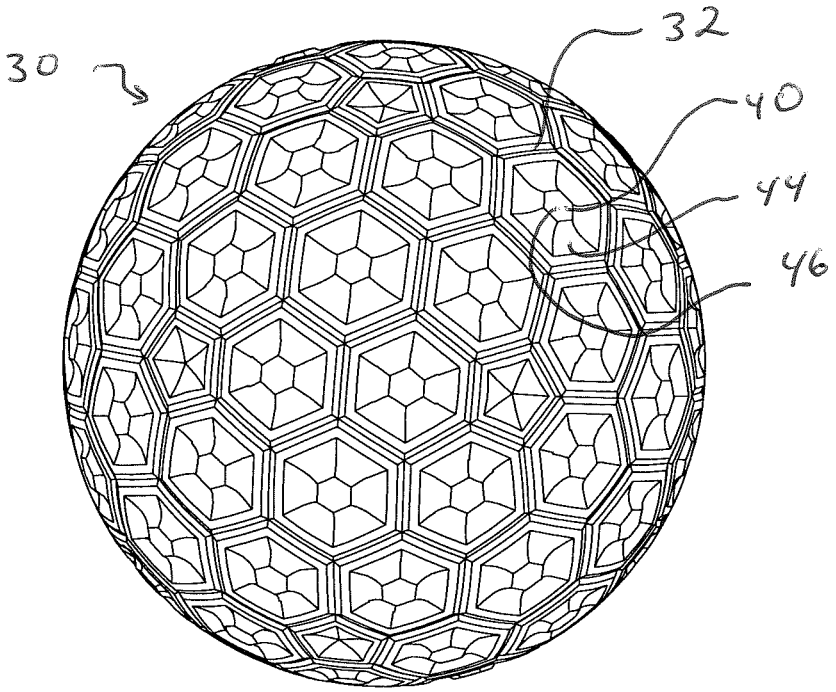
FIG. 33 shows another exemplary channel pattern arranged in an icosahedral pattern with a plurality of spherical polygonal tiles formed therebetween, wherein each tile is formed into an annular polygonal dimple.

In yet another embodiment as set forth in FIG. 33, it is possible to provide dimple 40 structure with a concaved, curved portion 44 comprised of multiple facets and a raised structure 46 within the dimple that reaches a height approximately coincident with the phantom spherical ball surface at that point. This structure provides the benefit of additional surface contours to improve the aerodynamic effect of the dimple. A secondary benefit is improved sphericity for a truer role when putting. This embodiment is similar to that of FIG. 32, but the larger hexagonal dimples 40 have been provided with hexagonal plateaus 46 at their centers. The tops of the plateaus 46 coincide with the phantom spherical surface of the ball 30 and thus creating ring-shaped dimples.

Figure 34:
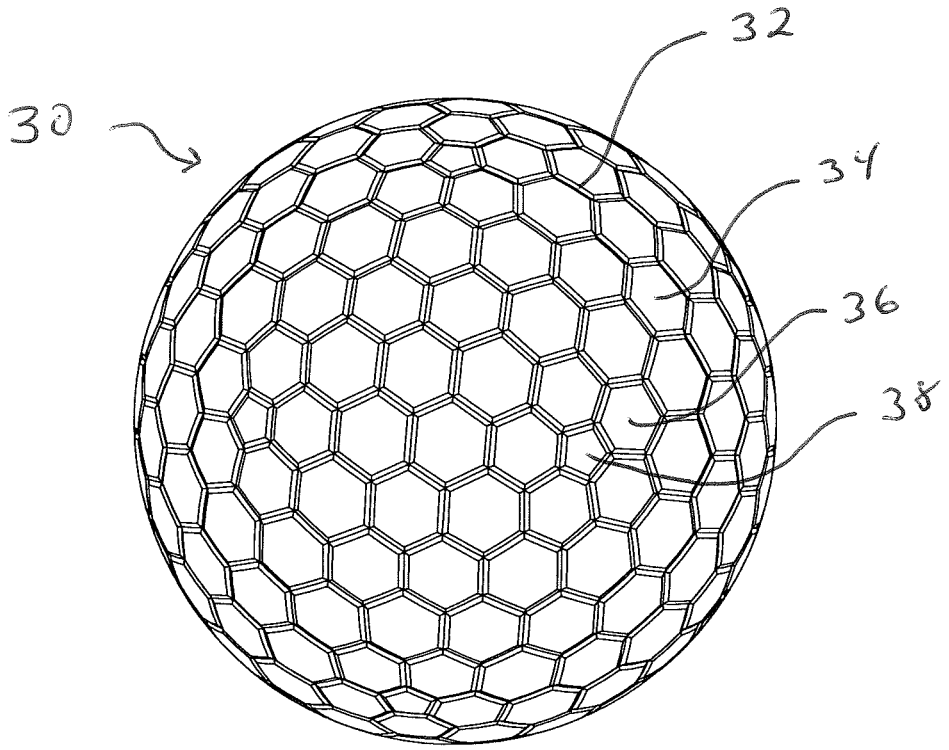
FIG. 34 shows an exemplary channel pattern arranged in an icosahedral pattern with a plurality of 252 spherical polygonal tiles formed therebetween.
Figure 35:
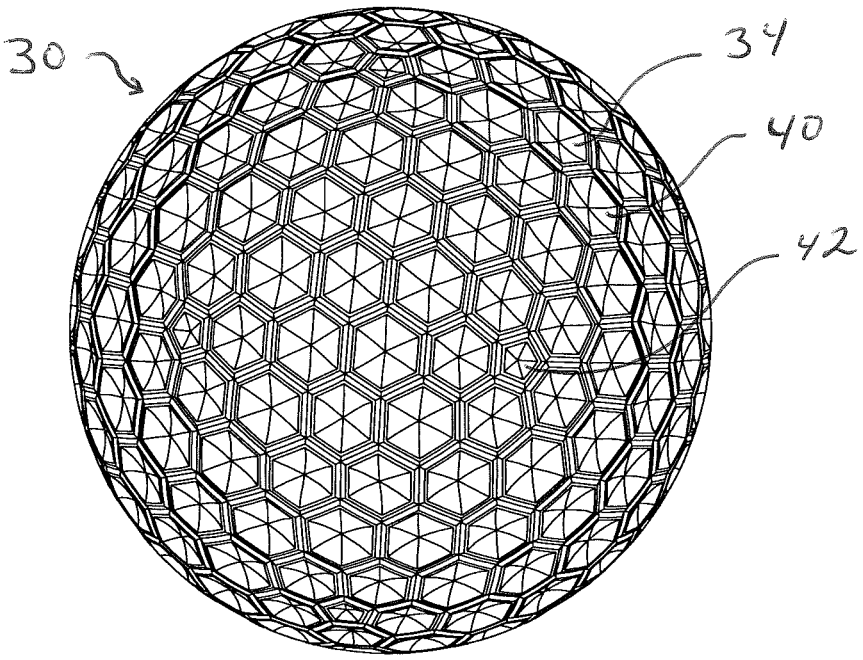
FIG. 35 shows an exemplary channel pattern arranged in an icosahedral pattern with a plurality of 252 spherical polygonal tiles formed therebetween, wherein each tile is formed into a polygonal dimple.

The present invention can also comprise a larger number of smaller dimples. FIG. 34 shows an example of a golf ball 30 with grooves or channels 32 arranged in accordance with an icosahedral based pattern having 252 polygonal tiles 34. The channels 32 delineate 240 hexagonal tiles 36 and 12 pentagonal tiles 38 on the surface of the ball. FIG. 35 demonstrates how the groove pattern of FIG. 34 can be comprised of multiple dimples 40, 42 by having each of the polygonal tiles 34 formed into a corresponding hexagonal dimple 40 or pentagonal dimple 42 with an annular land area around each dimple. Again, it is preferred that the edge angles of the dimples 40, 42 be between about 10° and about 16°. Thus, even in this configuration, it is preferred that the edge angles of the dimples 40, 42 be less than the edge angle of the channels 32 as set forth above.

Figure 36:
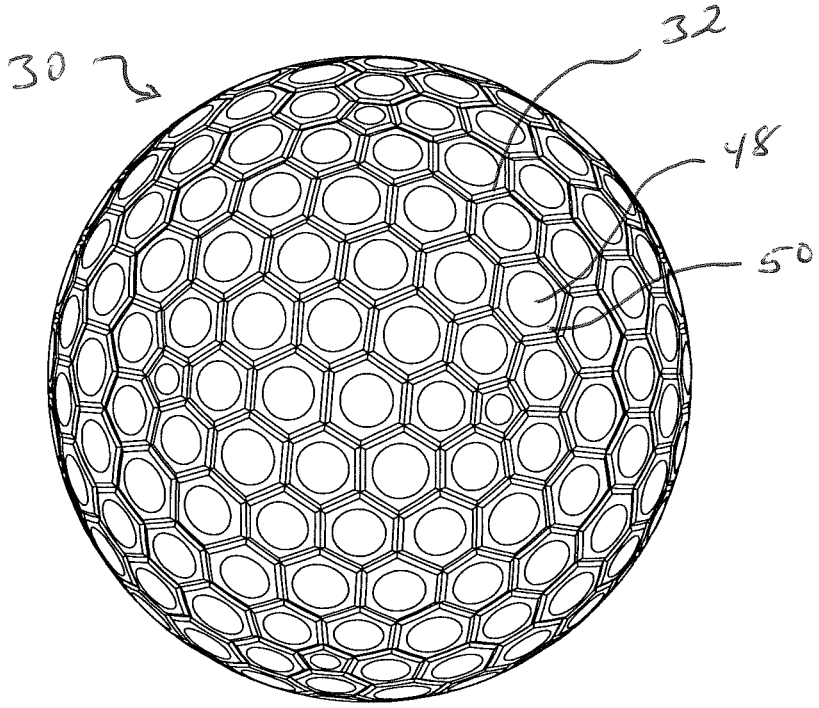
FIG. 36 shows exemplary channel pattern arranged in an icosahedral pattern with a plurality of 252 spherical polygonal tiles formed therebetween, wherein a spherical dimple is formed in each tile.

The configuration of channels 32 and dimples 48 of the ball 30 in FIG. 36 is similar to the pattern of FIG. 35 with each of the polygonal tiles having a circular dimple 48 and an annular land area 50 of non-uniform width juxtaposed between each dimple 48 and the channels 32. Other shapes can be used as well, such as ellipses, oval, oblong shapes, egg shapes, faceted, or rounded polygons. In a preferred embodiment, each of the polygonal tiles 34 can be filed with a spherical polygonal dimple such as those disclosed in U.S. Pat. No. 7,309,298, which is incorporated by reference herein for the complete disclosure of the spherical polygonal dimples. It is also known that the spherical tiles formed by the channels 32 can be filled with a plurality of circular dimples. Preferably, the hexagonal tiles can be filled with 3, 6 or 7 circular dimples and the pentagon tiles can be filled with 5 or 6 circular dimples.

Figure 37:
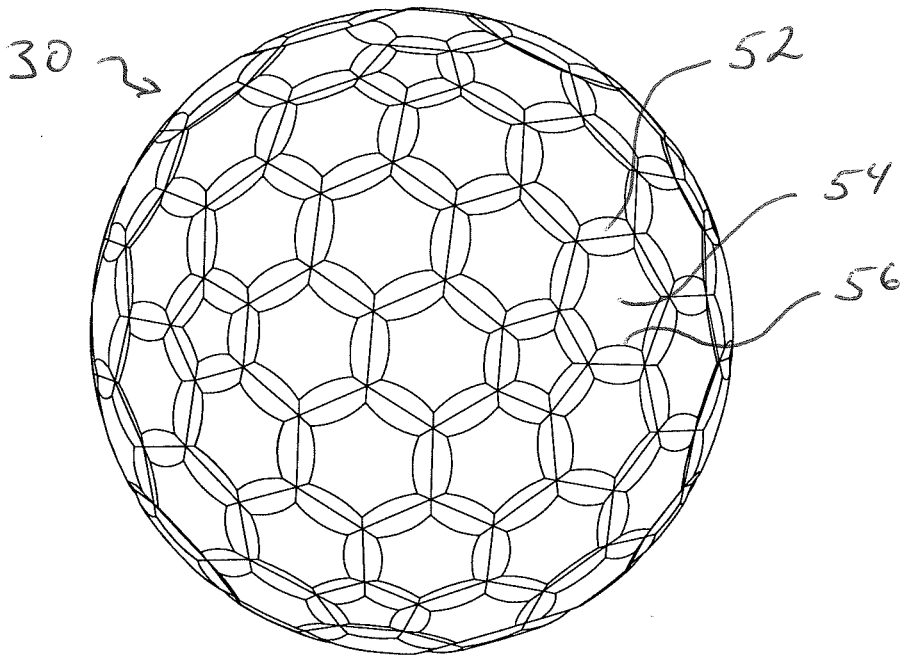
FIG. 37 shows an exemplary channel pattern arranged in an icosahedral pattern with a plurality of spherical polygonal tiles formed therebetween.

FIG. 37 demonstrates another embodiment of the present invention wherein the channels 52 do not have a uniform width or depth like those set forth in FIG. 31, but have a constant depth. As set forth above, the depth of the channels according to the present invention is preferably between about 0.005 and 0.03 inches. More preferably, the depths of the channels are between about 0.01 and 0.02 inches. In this embodiment, the edges 56 of the polygonal tiles 54 are smoothly rounded. However, as set forth in the examples above, the edges 56 do not need to be smooth as set forth here. For example, the channels set forth in FIGS. 3 and 4 would form sinusoidal edges and jagged edges, respectively.

Figure 38:
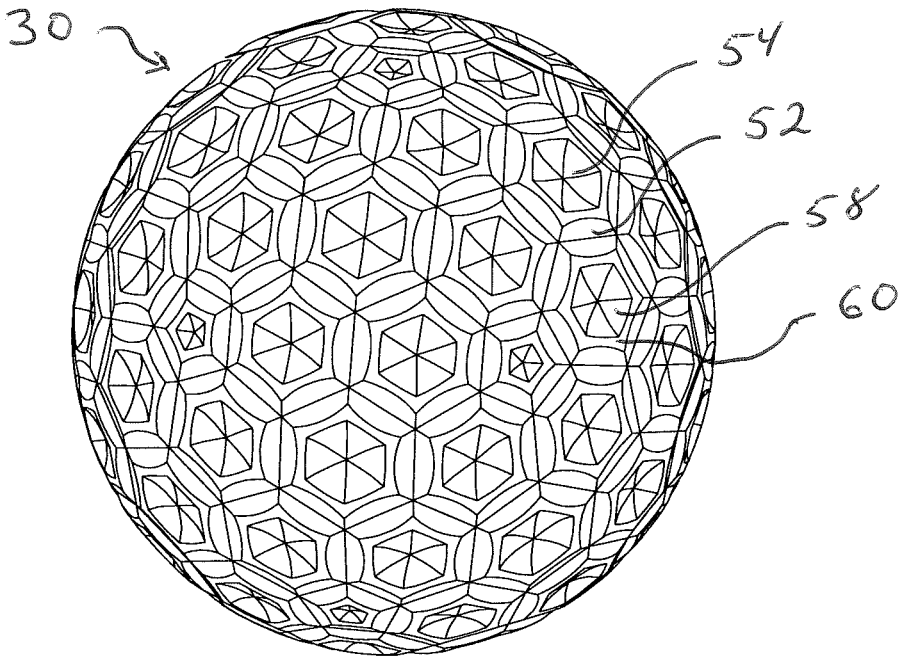
FIG. 38 shows an exemplary channel pattern arranged in an icosahedral pattern with a plurality of spherical polygonal tiles formed therebetween, wherein each tile is formed into a polygonal dimple.

FIG. 38 demonstrates that dimples 58 can be located in the spherical tiles 54, which creates an uneven widthed land area 60 juxtaposed between the dimples 58 and the channels 52. In all of these embodiments, it is preferred that the dimples have a depth that is similar to or greater than the depth of the channels.

Figure 39:
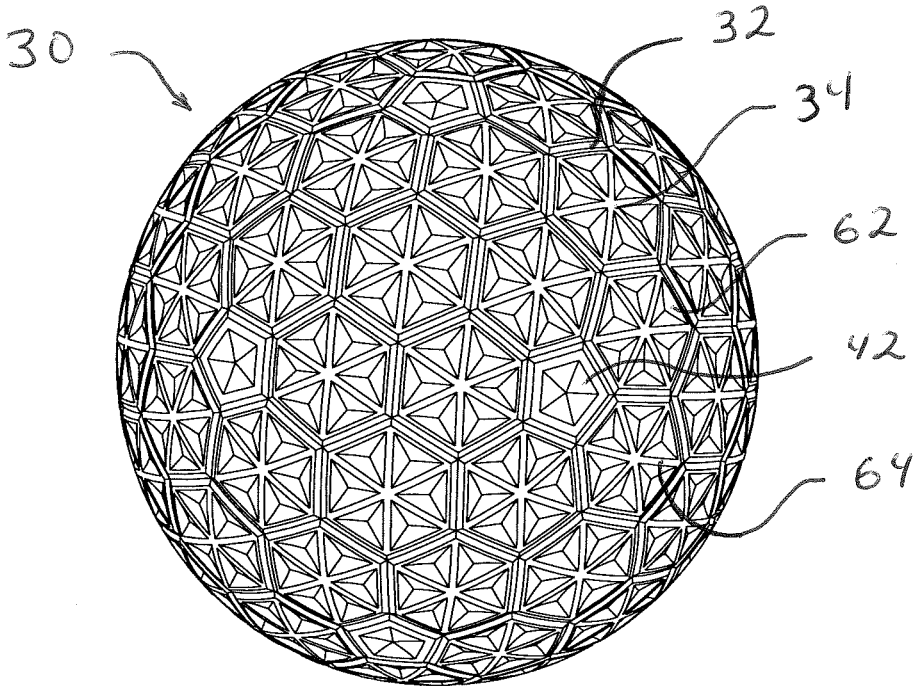
FIG. 39 shows another exemplary channel pattern arranged in an icosahedral pattern with a plurality of spherical polygonal tiles formed therebetween, wherein the majority of tiles are formed into a plurality of polygonal dimples.

FIG. 39 illustrates yet a further embodiment of a golf ball 30 having channels 32 that form spherical tiles 34 where the spherical tiles 34 are filled with a plurality of polygonal dimples 62. In this embodiment, the hexagonal tiles 34 are each filled with six triangular dimples that in turn define six, spoked land surfaces 64 therebetween.

Figure 40:
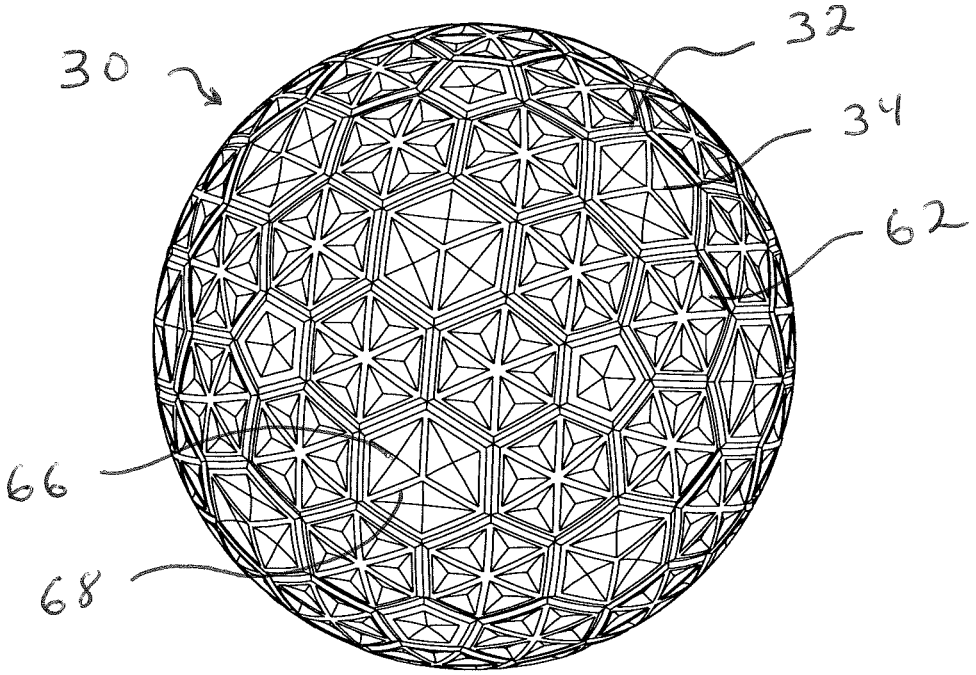
FIG. 40 shows still another exemplary channel pattern arranged in an icosahedral pattern with a plurality of spherical polygonal tiles formed therebetween, wherein the majority of tiles are formed into a plurality of polygonal dimples.

FIG. 40 illustrates yet a further embodiment of a golf ball 30 having channels 32 that form spherical tiles 34 where the spherical tiles 34 are filled with a plurality of polygonal dimples 62 and 66. In this embodiment, some of the hexagonal tiles 34 are each filled with 6 triangular dimples 62 and the remainder are filled with three diamond-shaped dimples 66 that in turn define 3, spoked land surfaces 68 therebetween. It is understood that all of the hexagonal tiles can be filled with the same shaped dimples such as the diamond shaped dimples, triangular dimples or trapezoidal dimples or the ball can be comprised of spherical tiles that are filed with different shaped dimples.

In these embodiments, there are preferably between about 90 and about 400 spherical tiles 34 defined by the channels 32. The channel surface pattern system 32 covers from about 5% to about 40% of the outer surface. Preferably, the edge angle of the at least one channel ranges from about 16° to about 90° and the at least one channel 32 surrounds or forms a plurality of spherical polygonal tiles. The plurality of dimples disposed within the spherical polygonal tiles cover about 40% to about 90% of the outer surface of the ball. Preferably, the channel(s) and the dimples together cover about 60% to about 100% of the outer surface. Even more preferably, the channel(s) and the dimples together cover about 70% to about 90% of the outer surface, where the channel(s) covers from about 5% to about 20% of the outer surface.

Referring to FIGS. 32-40, it is preferred that the edge angle of the channel 32 is greater than the edge angle of the dimples. For example, the edge angle of the channel 32 can range from about 18° to about 40°, and more preferably, the edge angle of the channel 32 ranges from about 20° to about 30°. Whereas, the edge angles of the dimples are preferably less than 20° and even more preferably less than 18°. Most preferably, the golf ball 30 is formed with a channel system 32 and between about 92 and 500 dimples formed in the spherical polygonal tiles 34.

The dimple arrangement of the present invention has an aerodynamic coefficient magnitude defined by $C_{mag}=\sqrt{(C_L^2+C_D^2)}$ and an aerodynamic force angle defined by Angle= $\tan^{-1}(C_L/C_D)$, wherein $C_L$ is a lift coefficient and $C_D$ is a drag coefficient. Further discussions of aerodynamic coefficient magnitude preferred for the present invention can be found in U.S. Pat. No. 7,156,757, which is incorporated herein by reference in its entirety.

While it is apparent that the illustrative embodiments of the invention disclosed herein fulfill the objectives of the present invention, it is appreciated that numerous modifications and other embodiments may be devised by those skilled in the art.

Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball comprising an outer surface comprising a channel surface pattern system comprising at least one channel defined on the outer surface, wherein the channel surface pattern system covers from about 5% to about 40% of the outer surface and wherein the edge angle of the at least one channel ranges from about 16° to about 90°, wherein the at least one channel surrounds a plurality of spherical polygonal tiles, and wherein the outer surface further comprises a plurality of dimples disposed within the spherical polygonal tiles and the dimples cover about 40% to about 90% of the outer surface.

2. The golf ball of claim 1, wherein the at least one channel and the dimples together cover about 60% to about 100% of the outer surface.

3. The golf ball of claim 2, wherein the at least one channel and the dimples together cover about 70% to about 90% of the outer surface.

4. The golf ball of claim 1, wherein the at least one channel covers from about 5% to about 20% of the outer surface.

5. The golf ball of claim 1, wherein the dimples comprise circular dimples.

6. The golf ball of claim 1, wherein the dimples comprise polygonal dimples.

7. The golf ball of claim 1, wherein the edge angle of the at least one channel is greater than the edge angle of the dimples.

8. The golf ball of claim 1, wherein the edge angle of the channel ranges from about 18° to about 40°.

9. The golf ball of claim 1, wherein the edge angle of the channel ranges from about 20° to about 30°.

10. A golf ball comprising an outer surface comprising a channel surface pattern system comprising at least one channel defined on the outer surface, wherein the channel surface pattern system covers from about 5% to about 40% of the outer surface and wherein the edge angle of the at least one channel ranges from about 16° to about 90°, wherein the at least one channel surrounds a plurality of spherical polygonal tiles, and wherein each of the spherical polygonal tiles includes at least one dimple formed therein.

11. The golf ball of claim 10, wherein each of the spherical polygonal tiles includes a plurality of at least two dimples formed therein.

12. The golf ball of claim 11, wherein a plurality of the spherical polygonal tiles are hexagons that further include six triangular dimples, three diamond shaped dimples or two trapezoidal dimples therein.

13. A golf ball comprising an outer surface comprising a channel surface pattern system comprising at least one channel defined on the outer surface, wherein the channel surface pattern system covers from about 5% to about 40% of the outer surface and wherein the edge angle of the at least one channel ranges from about 16° to about 90°, wherein the at least one channel surrounds a plurality of spherical polygonal tiles, wherein the channel surface pattern system comprises a plurality of channels that do not intersect each other and form a plurality of spherical polygonal tiles on the outer surface, and wherein the plurality of channels form hexagonal tiles.

14. The golf ball of claim 13, wherein the plurality of channels further form pentagonal tiles.

15. The golf ball of claim 13, wherein the plurality of channels have edge angles that range from about 18° to about 40°.

16. The golf ball of claim 13, wherein the plurality of channels have edge angles that range from about 20° to about 30°.

* * * * *